US008358193B2

(12) United States Patent
Dalmia et al.

(10) Patent No.: US 8,358,193 B2
(45) Date of Patent: Jan. 22, 2013

(54) PLANAR INDUCTOR DEVICES

(75) Inventors: Sidharth Dalmia, Fair Oaks, CA (US); Shanit Vannala, Antelope, CA (US); Zhuowen Sun, Sacramento, CA (US); Steven R. Kubes, El Dorado Hills, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 110 days.

(21) Appl. No.: 13/086,981

(22) Filed: Apr. 14, 2011

(65) Prior Publication Data

US 2011/0291787 A1 Dec. 1, 2011

Related U.S. Application Data

(60) Provisional application No. 61/396,464, filed on May 26, 2010.

(51) Int. Cl.
*H01F 27/28* (2006.01)

(52) U.S. Cl. ..... 336/229

(58) Field of Classification Search ..... 336/65, 336/83, 200, 225, 229, 232, 220–223
See application file for complete search history.

(56) References Cited

U.S. PATENT DOCUMENTS

| | | | |
|---|---|---|---|
| 3,881,244 | A | 5/1975 | Kendall |
| 5,055,816 | A | 10/1991 | Altman et al. |
| 5,191,699 | A | 3/1993 | Ganslmeier et al. |
| 6,148,500 | A | 11/2000 | Krone et al. |
| 7,158,005 | B2 | 1/2007 | Pleskach et al. |
| 7,271,697 | B2 | 9/2007 | Whittaker et al. |
| 7,671,716 | B2 | 3/2010 | Chen |
| 7,821,374 | B2 | 10/2010 | Harrison et al. |
| 2003/0048168 | A1 | 3/2003 | Schutten et al. |
| 2004/0212475 | A1 | 10/2004 | Schumacher |
| 2005/0174816 | A1 | 8/2005 | Nishikawa et al. |
| 2006/0125586 | A1 | 6/2006 | Lee et al. |
| 2007/0132538 | A1 | 6/2007 | Catalano et al. |
| 2009/0002111 | A1 | 1/2009 | Harrison et al. |
| 2010/0295646 | A1 | 11/2010 | Harrison et al. |
| 2011/0108317 | A1 | 5/2011 | Harrison et al. |

FOREIGN PATENT DOCUMENTS

| | | |
|---|---|---|
| WO | WO 2008/088682 | 7/2008 |
| WO | WO 2010/065113 | 6/2010 |

OTHER PUBLICATIONS

Shocking Technologies website, <http://www.shockingtechnologies.com>.

International Search Report, International Application No. PCT/2011/000922, International filing Date May 24, 2011.

*Primary Examiner* — Tuyen Nguyen

(57) ABSTRACT

A planar inductor device includes a ferrite body and a conductive pathway, The ferrite body extends around an opening in the ferrite body. The conductive pathway includes an input section, a current-splitting section, a coil section, a current-combining section, and an output section connected with each other, the input section extending toward the opening in the ferrite body. The current-splitting section includes a plurality of conductive coils joined with the conductive pathway and electrically disposed parallel to each other. The coil section includes the conductive coils helically wrapped around the ferrite body. The current-combining section includes the conductive coils joined with each other. The output section includes the joined conductive coils extending out of the ferrite body.

20 Claims, 16 Drawing Sheets

PLANAR INDUCTOR DEVICES

CROSS-REFERENCE TO RELATED APPLICATIONS

This application claims priority benefit to U.S. Provisional Application No. 61/396,464, which is entitled "A Method Of Fabricating Electronic Components Using Embedded Ferrites In Laminate Technology" and was filed on May 26, 2010 (the "'464 Application"). This application is related to U.S. application Ser. No. 13/087,112, which is entitled "Planar Inductor Devices," was filed on Apr. 14, 2011. This application also is related to U.S. application Ser. No. 13/087,068, which is entitled "Planar Inductor Devices," was filed on Apr. 14, 2011. The entire subject matter disclosed in each of the '464 Application, the '112 Application, and the '068 Application is incorporated by reference herein.

BACKGROUND OF THE INVENTION

The subject matter herein relates generally to electronic devices, such as transformers, inductors, filters, couplers, baluns, diplexers, multiplexers, modules or chokes.

Some electronic inductive devices include conductive coils wrapped around a ferrite component. For example, the inductive devices can include one or more inductors, transformers, or chokes. In general, a wire or set of wires is helically wrapped around an iron or magnetic body several times. Current flows through the wire and generates magnetic flux in the magnetic body. The magnetic flux may be used to induce current in another conductive coil and/or filter out components of the current.

Some of these known inductive devices are not without their shortcomings. For example, traditional inductors, transformers, or chokes can be relatively large and/or limited in topology and performance, especially in the context of Ethernet devices and other communication devices. The ferrites can be relatively large, and the conductive coils that are hand or machine-wrapped around the ferrites can consume relatively large amounts of space. Such inductive devices may need to be mounted on top of circuit boards that are included in the communication device and, as a result, increase the size of the communication device.

However, when the size of the inductive device is decreased, the relatively brittle ferrites may be damaged and/or break during incorporation of the inductor, transformer, or choke into the communication device. For example, the hand- or machine-wrapping of conductive wire around the relatively small ferrites can be difficult, if not impossible to reliably achieve.

A need exists for smaller inductive devices that include ferrites with conductive coils extending around the ferrites.

SUMMARY OF THE INVENTION

In one embodiment, an inductor device is provided. The device includes a ferrite body and a conductive pathway. The ferrite body extends around an opening in the ferrite body. The conductive pathway includes an input section, a current-splitting section, a coil section, a current-combining section, and an output section connected with each other, the input section extending toward the opening in the ferrite body. The current-splitting section includes a plurality of conductive coils joined with the conductive pathway and electrically disposed parallel to each other. The coil section includes the conductive coils helically wrapped around the ferrite body. The current-combining section includes the conductive coils joined with each other. The output section includes the joined conductive coils extending out of the ferrite body.

In another embodiment, another planar inductor device is provided. The device includes a substrate, a ferrite body, and a plurality of conductors and conductive vias. The substrate vertically extends between an upper surface and an opposite lower surface. The ferrite body is disposed in the substrate between the upper surface and the lower surface. The ferrite body has an opening that extends through the ferrite body. The conductors include an input conductor disposed between the ferrite body and the upper surface of the substrate, a current-splitting conductor disposed between the ferrite body and the lower surface of the substrate, and a current-combining conductor disposed between the ferrite body and the upper surface of the substrate. The vias include one or more conductive input vias coupled with both the input conductor and the current-splitting conductor and one or more current-splitting vias coupled with both the current-splitting conductor and the current-combining conductor. The input conductor, the current-splitting conductor, the current-combining conductor, the input vias, and the current-splitting vias form a conductive pathway that extends into the opening in the ferrite body and forms a plurality of conductive coils that each helically wrap around the ferrite body before combining back together and extending out of the opening in the ferrite body.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
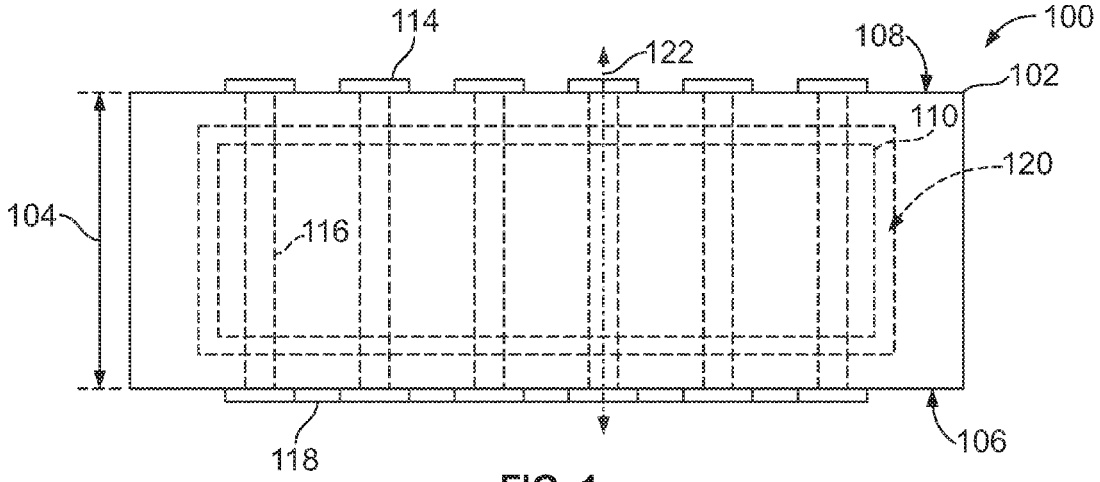
FIG. 1 is a side view of one embodiment of a planar inductor device.

FIG. 1 is a side view of one embodiment of a planar inductor device 100. The device 100 includes a planar substrate 102 with one or more electronic components of the device 100 embedded in the substrate 102. By "planar," it is meant that the substrate 102 is larger along two perpendicular dimensions than in a third perpendicular direction. The substrate 102 may be a flexible and non-rigid sheet, such as a sheet of cured epoxy, or a rigid or semi-rigid board, such as a printed circuit board (PCB) formed of FR-4.

The substrate 102 has a thickness dimension 104 that is vertically measured from a lower surface 106 to an opposite upper surface 108. The thickness dimension 104 may be relatively small, such as 2.5 millimeters or less, 2.0 millimeters or less, 1.0 millimeters or less, or another distance. Alternatively, the thickness dimension 104 may be a larger distance.

In one embodiment, the substrate 102 includes an interior cavity 120. The interior cavity 120 may be at least partially filled with a flexible material, such as cured epoxy, or with air. A ferrite body 110 is entirely disposed within the substrate 102 in one embodiment. For example, the ferrite body 110 may be located in the interior cavity 120 surrounded by the flexible material or air. The ferrite body 110 can be entirely disposed within the thickness dimension 104 of the substrate 102 and not protrude or project through a plane defined by the upper surface 108 of the substrate 102 and/or a plane defined by the lower surface 106. The ferrite body 110 may be positioned within a cavity of a substrate with the cavity being filled with air or a flexible material (such as epoxy) in accordance with one or more embodiments described in U.S. patent application Ser. No. 12/699,777, which is entitled "Packaged Structure Having Magnetic Component And Method Thereof" (referred to herein as "'777 Application") and/or U.S. patent application Ser. No. 12/592,771, which is entitled "Manufacture And Use Of Planar Embedded Magnetics As Discrete Components And In Integrated Connectors" (referred to herein as the "'771 Application"). The entire disclosures of the '777 and the '771 Applications are incorporated by reference herein.

The ferrite body 110 is shown as having an approximately rectangular shape. Alternatively, the ferrite body 110 may have another shape, such as a cylinder, toroid, annulus, E-shape, and the like. The ferrite body 110 may include or be formed from iron, an iron alloy, or a magnetic material. The ferrite body 110 can be enveloped in a flexible elastic epoxy or in air cavity within the cavity 120 of the substrate 102. When the ferrite body 110 is enveloped in epoxy, the epoxy can be premixed with high permeability materials aid or increase the inductance per unit length of the ferrite body 110. Examples of such high permeability materials include cobalt, nickel, manganese, chromium, iron, and the like. Alternatively, the cavity 120 of the substrate 102 can be filled or substantially filled with an epoxy having high permeability materials without the ferrite body 110 being disposed within the substrate 102. For example, the ferrite body 110 may be replaced with a body formed from an epoxy having high permeability materials in the epoxy.

The device 100 includes a plurality of interconnected upper conductors 114, conductive vias 116, and lower conductors 118. The upper conductors 114 may include conductive traces that are deposited on the upper surface 108 of the substrate 102 and/or below the upper surface 108. For example, the substrate 102 may include a plurality of sub-layers stacked on top of each other, such as on one or more layers of FR-4 stacked on top of each other. The upper conductors 114 can be deposited on or in one of the sub-layers disposed below the upper surface 108. The lower conductors 118 may include conductive traces that are deposited on the lower surface 106 of the substrate 102 and/or above the lower surface 106. For example, the lower conductors 118 may be deposited on or in one of the sub-layers disposed above the lower surface 106.

The vias 116 may be formed as holes or channels that vertically extend through all or a portion of the thickness dimension 104 of the substrate 102. In one embodiment, the vias 116 are formed using lasers and/or mechanical drilling of the substrate 102. For example, the vias 116 may be formed into the substrate 102 using CO2 lasers, ultraviolet (UV) lasers, and/or or multi-head mechanical drilling machines with via diameter sizes in the range of 25 micrometers to 500 micrometers. Alternatively, different techniques may be used to form the vias 116 and/or different sized vias 116 may be used.

In the illustrated embodiment, the vias 116 are disposed outside of the cavity 120 of the substrate 102. For example, the vias 116 shown in FIG. 2 do not extend through the cavity 120. Alternatively, the vias 116 may at least partially extend through the cavity 120. For example, at least a portion of the vias 116 located inside the substrate 102 may extend through the cavity 120 and/or the flexible material or air inside the cavity 120.

The vias 116 may extend through the entirety of the thickness dimension 104 along center axes 122 from the upper surface 108 to the lower surface 106. The vias 116 may be filed with a conductive material, such as a conductive solder, and/or may be conductively plated. For example, the exposed surfaces of the substrate 102 inside the vias 116 may be plated with a conductive material, such as a metal or metal alloy. The vias 116 conductively couple the upper conductors 114 with the lower conductors 118.

In one embodiment, one or more of the upper conductors 114 and/or the lower conductors 118 may be formed from a combination of conductive traces and wire bonds. For example, the vias 116 may extend through the substrate 102 and be conductively coupled with the conductive traces and wire bonds of the upper conductors 114 and with the lower conductors 118.

Figure 2:
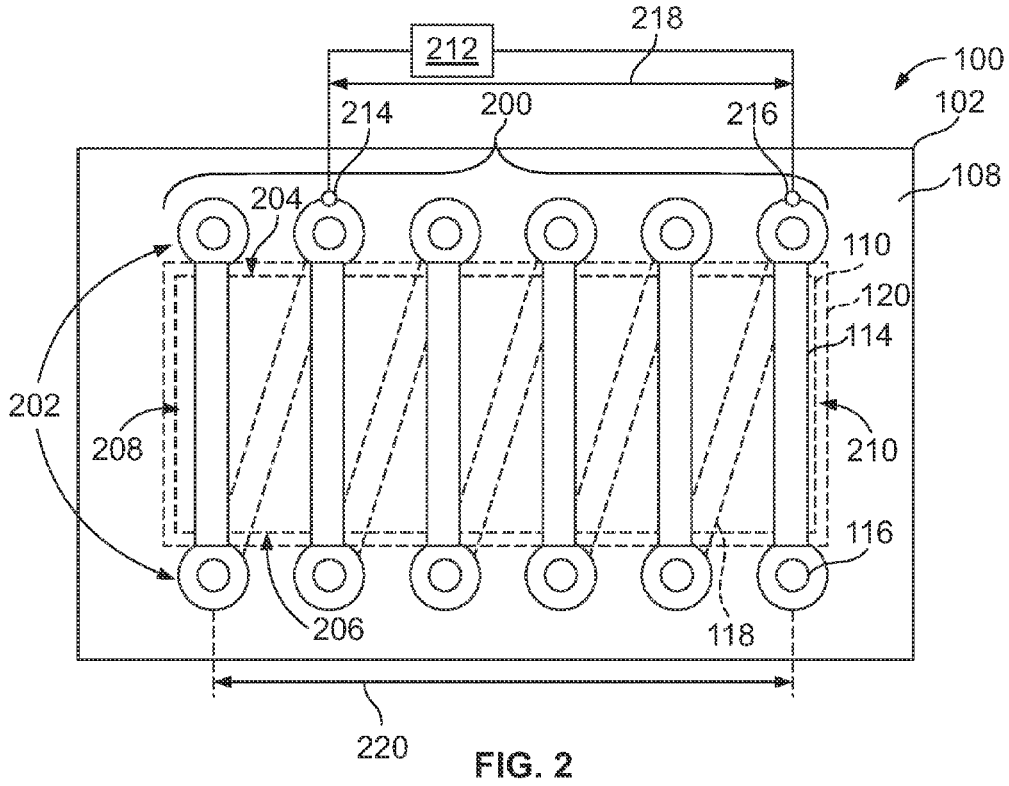
FIG. 2 is a top view of an upper surface of the planar inductor device shown in FIG. 1.

FIG. 2 is a top view of the upper surface 108 of the planar inductor device 100. The upper conductors 114, the lower conductors 118, and the vias 116 are arranged around the ferrite body 110 to form a conductive coil 200. For example, the vias 116 are arranged in a plurality of pairs 202, with each pair 202 including vias 116 on opposite sides 204, 206 of the ferrite body 110. The vias 116 in each pair 202 are conductively coupled along the upper surface 108 of the substrate 102 by one of the upper conductors 114 in the illustrated embodiment. Alternatively, the vias 116 may be coupled by more than one of the upper conductors 114. As shown in FIG. 2, the upper conductors 114 are elongated conductive bodies that extend from a first via 116 in each pair 202 to a second, opposite via 116 in the same pair 202.

The vias 116 vertically extend through the substrate 102 on opposite sides of the ferrite body 110 from the upper conductors 114 to the lower conductors 118. In the illustrated embodiment, the vias 116 have circular shapes, but alternatively may have another shape, such as a polygon shape. The vias 116 define channels or holes that vertically extend through the substrate 102. As shown in FIG. 2, the vias 116 are encircled by the substrate 102. For example, the substrate 102 extends around and encircles the entire outer periphery of the vias 116 throughout the thickness dimension 104 of the substrate 102. The channels or holes of the vias 116 are only open at the upper surface 108 and at the lower surface 106 of the vias 116 but are surrounded by the substrate 102 from the lower surface 106 to the upper surface 108 in the illustrated embodiment.

While the illustrated embodiment is a single coil device, multiple conductive pathways can be helically wrapped around the ferrite body to form chokes and transformers having two or more conductive coils. For Power over Ethernet (POE) or other applications, a longer bar shape-inductor device that can accommodate two or more conductive coils may be used. Each pair of conductive coils can support an opposite polarity of a voltage required for the POE application. If the two or more conductive coils are wound in the same direction around the ferrite body, the ferrite body may not saturate for the POE application.

As shown in FIG. 2, each lower conductor 118 conductively couples vias 116 in different pairs 202 of the vias 116. For example, each lower conductor 118 conductively couples a first via 116 in a first pair 202 of the vias 116 on the first side 204 of the ferrite body 110 with a second via 116 in a second, different pair 202 of the vias 116 on the opposite second side 206 of the ferrite body 110. The lower conductors 118 are elongated conductive bodies in the illustrated embodiment. The lower conductors 118 and the upper conductors 114 are obliquely oriented relative to each other. For example, as shown in FIG. 2, the lower conductors 118 are elongated along directions disposed at acute angles relative to the directions along which the upper conductors 114 are elongated.

The conductively coupled upper conductors 114, the vias 116, and the lower conductors 118 form the conductive coil 200 that helically wraps or encircles the ferrite body 110. By "encircle," the conductive coil 200 may follow a helical path that moves around the outer perimeter of the ferrite body 110. An encircling path of the conductive coil 200 can extend around an entire 360 degrees of the ferrite body 110, even though the upper conductors 114, the vias 116, and the lower conductors 118 do not follow a pathway that is a perfect circle.

The coil 200 can extend from a first via 116 disposed along the first side 204 of the ferrite body 110 to a second via 116 in the same pair 202 of the vias 116 on the opposite, second side 206 of the ferrite body 110. The second via 116 extends along the second side 206 of the ferrite body 110 through the thickness dimension 104 of the substrate 102 to a first lower conductor 118. The first lower conductor 118 conductively couples the second via 116 with a third via 116 in a second, different pair 202 of the vias 116 on the first side 204 of the ferrite body 110. The third via 116 extends along the first side 204 of the ferrite body 110 to a first upper conductor 114. The first upper conductor 114 conductively couples the third via 116 with a fourth via 116 in the same set 202 of the vias 116. The remaining vias 116, upper conductors 114, and lower conductors 118 continue to form the conductive coil 200 that wraps around the ferrite body 110.

In the illustrated embodiment, the ferrite body 110 is elongated between opposite first and second ends 208, 210. The coil 200 helically wraps around the ferrite body 110 from at or near the first end 208 toward the opposite end 210. The coil 200 has a lateral length dimension 220 that is measured along the length of the coil 200 and in a direction that is perpendicular to the thickness dimension 104. The length dimension 220 may be measured from center lines of the vias 116 on opposite ends of the coil 200.

The device 100 may be included into or connected to an electric circuit 212 to provide an inductive element, or inductor, to the circuit. For example, two or more of the vias 116, the upper conductors 114, and/or the lower conductors 118 may be conductively coupled to conductors 214, 216 (e.g., wires, buses, terminals, contacts, or other conductive bodies) of the circuit. One conductor 214 of the circuit 212 can be coupled with a first via 116, upper conductor 114, or lower conductor 118 while the other conductor 216 of the circuit 212 is coupled with a second, different via 116, upper conductor 114, or lower conductor 118. In one embodiment, the circuit 212 is connected to two different vias 116 in different pairs 202 of the vias 116.

The device 100 may provide an inductive element to the circuit 212 that has an operator-customizable inductance characteristic. In operation, current from the circuit 212 flows through the coil 200 of the device 100. At least some of the energy of the current is stored as magnetic energy in the ferrite body 110. The coil 200 may be used to delay and/or reshape currents flowing through the circuit 212, such as by filtering relatively high frequencies from the current. The amount of magnetic energy stored in the ferrite body 110 can represent an inductance characteristic of the device 100. The inductance characteristic provided by the device 100 may be altered by changing a lateral distance dimension 218 between the contacts between the conductors 214, 216 and the coil 200. For example, the inductance of the device 100 may increase when the circuit 212 is connected to vias 116 (or upper conductors 114 and/or lower conductors 118) that are farther apart from each other. Conversely, the inductance of the device 100 may decrease when the circuit 212 is connected to vias 116, upper conductors 114, and/or lower conductors 118 that are disposed closer to each other.

Figure 18:
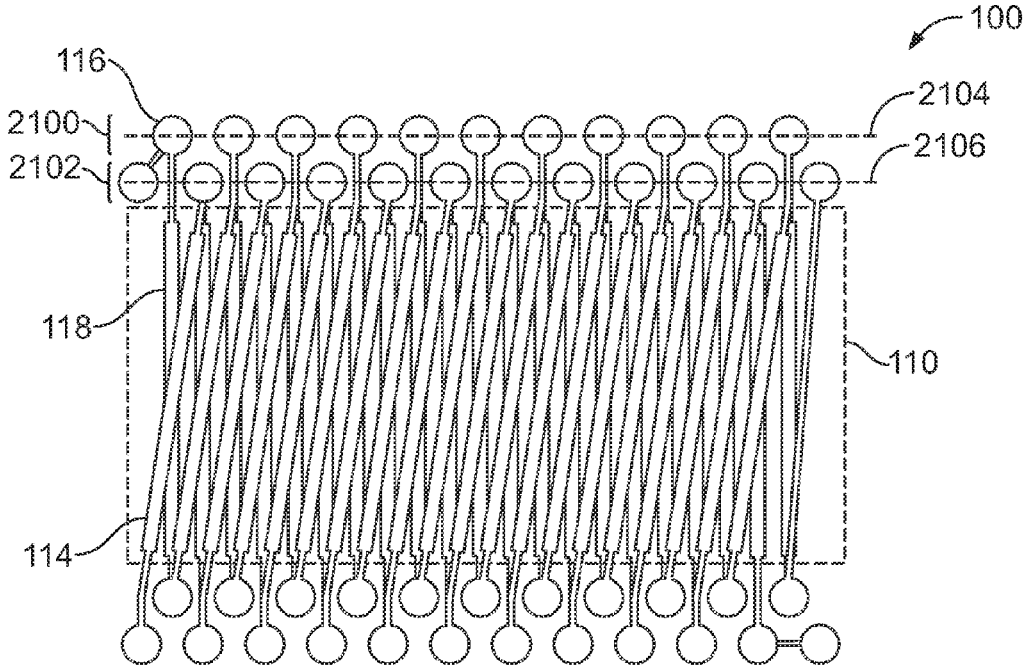
FIG. 18 is a top view of another embodiment of the planar inductor device shown in FIGS. 1 and 2.

FIG. 18 is a top view of another embodiment of the planar inductor device 100 shown in FIGS. 1 and 2 where 2 coils are wrapped around the ferrite body. The device 100 is shown without the substrate 102 in order to more clearly illustrate the upper conductors 114, lower conductors 118, and vias 116. The ferrite body 110 is shown in phantom so that the lower conductors 118 are visible. In the illustrated embodiment, the vias 116 are staggered so that the upper conductors 114 are closer to each other and the lower conductors 118 are closer to each other. For example, in the embodiment shown in FIG. 2, the vias 116 are linearly aligned with each other at the upper surface 108 and at the lower surface 106 of the substrate 102.

In contrast, the vias 116 in the embodiment shown in FIG. 18 are staggered on each side of the ferrite body 110 such that different groups 2100, 2102 of the vias 116 are linearly aligned along different lines 2104, 2106. The staggering of the vias 116 can cause the upper conductors 118 to be closer to each other and/or the lower conductors 114 to be closer to each other, as shown in FIG. 18. The inductance or impedance per unit length of the device 100 may be increased by locating the upper conductors 118 closer to each other and/or the lower conductors 114 closer to each other.

Figure 3:
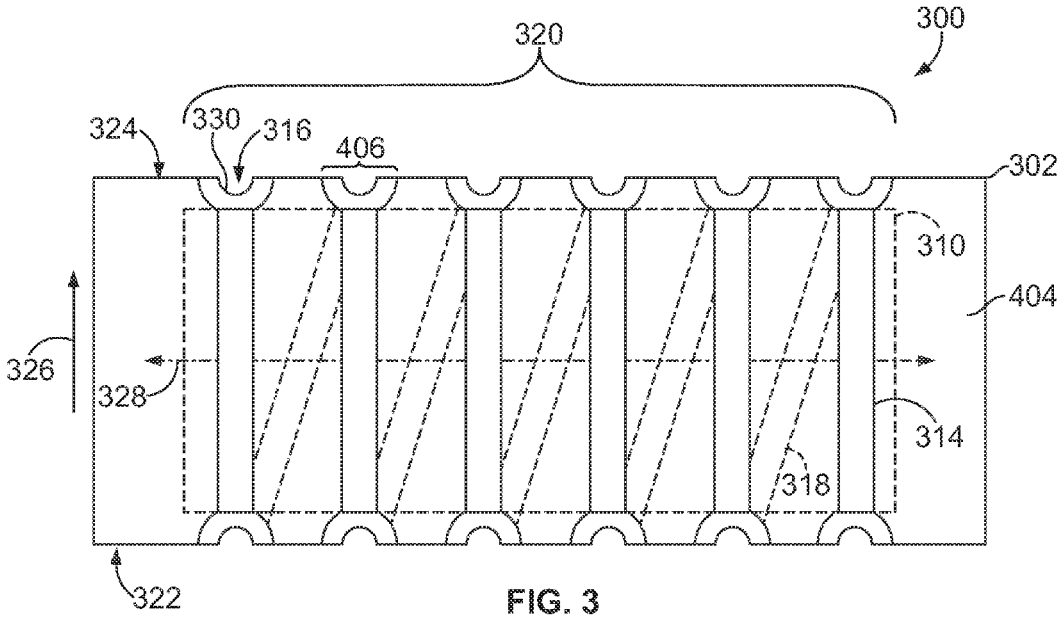
FIG. 3 is a top view of a planar inductor device in accordance with another embodiment.

FIG. 3 is a top view of a planar inductor device 300 in accordance with another embodiment. The device 300 may be similar to the device 100 shown in FIG. 1. For example, the device 300 includes a substrate 302 having a thickness dimension 400 (shown in FIG. 4) that vertically extends from a lower surface 402 (shown in FIG. 4) to an opposite upper surface 404 (shown in FIG. 4). The thickness dimension 400 may be relatively small, such as 2.5 millimeters or less, 2.0 millimeters or less, 1.0 millimeters or less, or another distance. Alternatively, the thickness dimension 400 may be a larger distance. The device 300 also includes a ferrite body 310 that may be entirely disposed within the thickness dimension 400 of the substrate 302. In one embodiment, the substrate 302 may include an interior cavity, such as the cavity 120 (shown in FIG. 1) of the substrate 102 (shown in FIG. 1), with the ferrite body 310 disposed in the cavity. Upper conductors 314 and lower conductors 318 are provided at or on upper and lower surfaces 404, 402 (shown in FIG. 4) of the substrate 302, respectively, and conductive vias 316 extend through the thickness dimension 400 of the substrate 302 and conductively couple the upper conductors 314 with the lower conductors 318. Similar to the device 100, the upper conductors 314, the lower conductors 318, and the vias 316 form a conductive coil 320 that helically wraps around the ferrite body 310.

One difference between the device 100 shown in FIG. 1 and the device 300 shown in FIG. 3 is that the vias 316 are not encircled or enclosed by the substrate 302 throughout the thickness dimension 400 (shown in FIG. 4) of the substrate 302. For example, the substrate 302 laterally extends between opposite edges 322, 324 along a lateral direction 326. The lateral direction 326 can be perpendicular to the vertical direction in which the thickness dimension 400 is measured and/or perpendicular to a center axis 328 of the coil 320 and that the coil 320 helically wraps around. As shown in FIG. 3, the edges 322, 324 extend through the vias 316 such that the vias 316 are at least partially exposed along the edges 322, 324.

Figure 4:
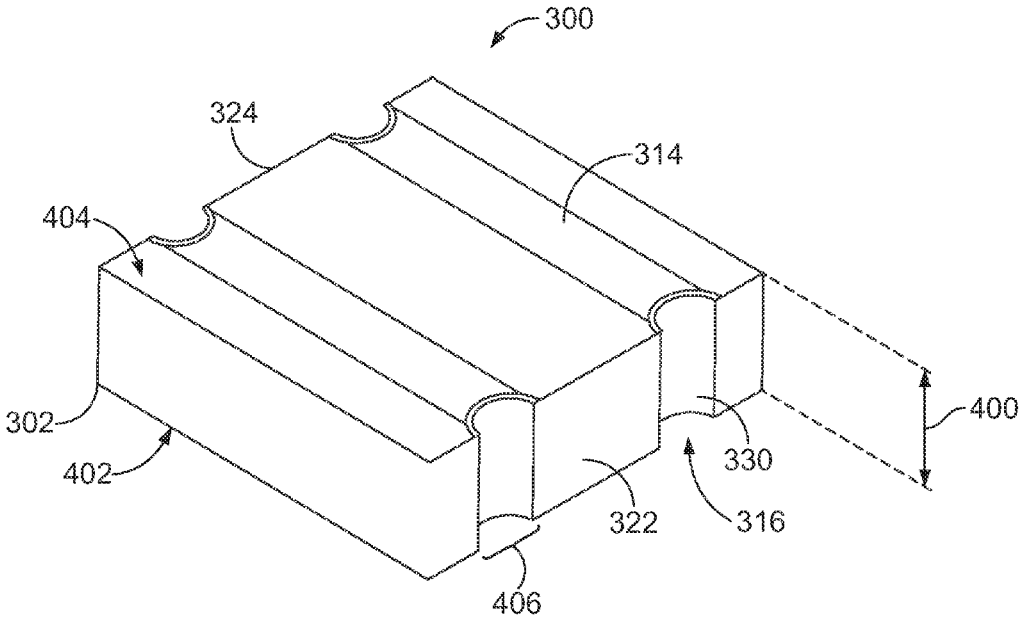
FIG. 4 is a perspective view of a portion of the inductor device shown in FIG. 3.

With continued reference to FIG. 3, FIG. 4 is a perspective view of a portion of the inductor device 300. As described above, the substrate 302 of the device 300 has the thickness dimension 400 that vertically extends from the lower surface 402 to the upper surface 404. The vias 316 shown in FIGS. 3 and 4 are plated vias. For example, the vias 316 are formed as holes or channels that extend through the thickness dimension 400 and have interior surfaces that are coated or plated with a conductive material, such as a metal or metal alloy. Alternatively, the vias 316 may be filled with a conductive material, such as a metal, metal alloy, or solder.

The edges 322, 324 of the substrate 302 "cut," or extend through, the vias 316 such that conductive interior surfaces 330 of the vias 316 are exposed. In contrast to the vias 116 (shown in FIG. 1) of the device 100 (shown in FIG. 1) that are encircled by the substrate 102 (shown in FIG. 1) throughout the thickness dimension 104 (shown in FIG. 1) of the substrate 102, the vias 316 are exposed and not entirely encircled by the substrate 302 throughout the thickness dimension 400 of the substrate 302. The exposed interior surfaces 330 of the vias 316 provide conductive castellations 406 of the device 300. The castellations 406 represent conductive surfaces of the device 300 that are conductively coupled with the coil 320 formed in the substrate 302 along one or more of the edges 322, 324 of the substrate 302. In one embodiment, the castellations 406 are provided by mechanically cutting and removing portions of the vias 316 and the substrate 302 along the edges 322, 324 to expose the edges 322, 324 and the vias 316. Alternatively, the vias 316 may be formed along the outer edges 322, 324 of the substrate 302 without mechanically cutting portions of the substrate 302. For example, semicircle channels may be formed into the edges 322, 324 of the substrate 302 and then plated with a conductive material to form the vias 316 shown in FIGS. 3 and 4.

Similar to the vias 116 shown in FIGS. 1 and 2, the castellations 406 conductively couple the lower conductors 318 (shown in FIG. 3) with the upper conductors 314 to form the coil 320 (shown in FIG. 3) that helically wraps around the ferrite body 310 (shown in FIG. 3). The device 300 may be included into or connected to an electric circuit that is similar to the electric circuit 212 (shown in FIG. 2) to provide an inductive element, or inductor, to the circuit. Such an electric circuit may be conductively coupled to two or more of the castellations 406 of the device 300. The castellations 406 may provide locations that are more easily coupled with the electric circuit. For example, the upper and/or lower surfaces 404, 402 may not be readily accessible and/or may be relatively difficult to access. The edges 322 and/or 324 may be exposed and/or more easily accessible for conductors (e.g., wires, busses, and the like) of the electric circuit to be conductively coupled with the castellations 406. Moreover, the castellations 406 can provide increased conductive areas with which the electric circuit may couple. For example, instead of coupling the electric circuit 212 with the portions of the vias 116 that are at or near the upper and/or lower surfaces 108, 106 of the substrate 102, the electric circuit 212 may couple with a much larger conductive area of the castellations 406 along the edges 322, 324 of the device 300. The larger conductive area of the castellations 406 can provide decreased electrical resistance between the coil 320 and the electric circuit.

Similar to the device 100 (shown in FIG. 1), the device 300 may provide an inductive element to the circuit 212 (shown in FIG. 2) that has an operator-customizable inductance characteristic. Similar to the inductance characteristic provided by the device 100, the inductance characteristic of the device 300 may be customized based on which castellations 406 are used to couple the coil 320 with the circuit 212. The inductance of the device 300 may increase when the circuit 212 is connected to castellations 406 located farther from each other or decrease when the circuit 212 is connected to castellations 406 located closer to each other. The ability to use different castellations 406 can provide for increased tenability of high precision inductors that may be used or required for filters, diplexers, multiplexers, or baluns. During a back end test, and as ferrites may vary by +/−20% in ferrite permeability, the castellations 406 can allow for binning depending on the value of the nominal inductance of the device 300. For example, if the device 300 having a predetermined number of turns of the coil 320 around the ferrite body 310, but the inductance of the device 300 is lower than expected due to variation in the permeability of the ferrite body 310 (e.g., a lower than expected permeability), then a user of the device 300 can use different castellations 406 to electrically couple a circuit with the device 300. The user may select other castellations 406 that can provide increased inductance of the device 300. For example, the user may use castellations 406 that are disposed farther apart. In one embodiment, the user can connect to the castellation 406 or castellations 406 that increase the inductance of the device 300 based on the number of additional turns of the coil 320 that are disposed between the selected castellations 406. As one example, the inductance of the device 300 may be proportional to $n^2$, where "n" represent the number of turns, or times that the coil 320 helically wraps around the ferrite body 300. If the user selects castellations 406 that are located such that there are 10 turns of the coil 320 between the castellations 406 and then changes one of the castellations 406 such that 9 turns of the coil 320 are between the selected castellations 406, then the inductance of the device 300 may be reduced by 20%.

Figure 5:
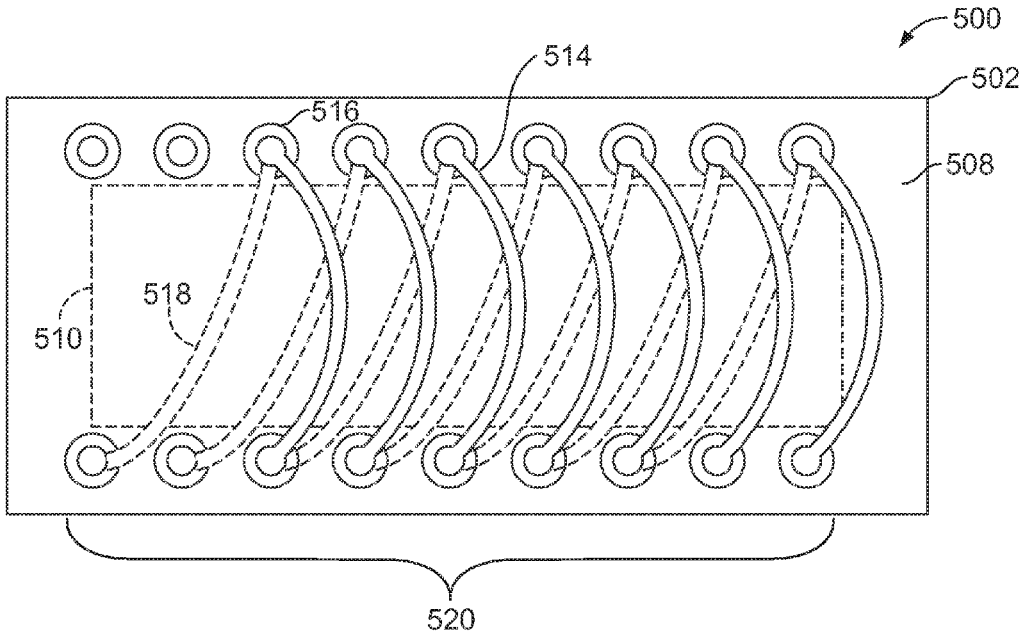
FIG. 5 is a top view of a planar inductor device in accordance with another embodiment.
Figure 6:
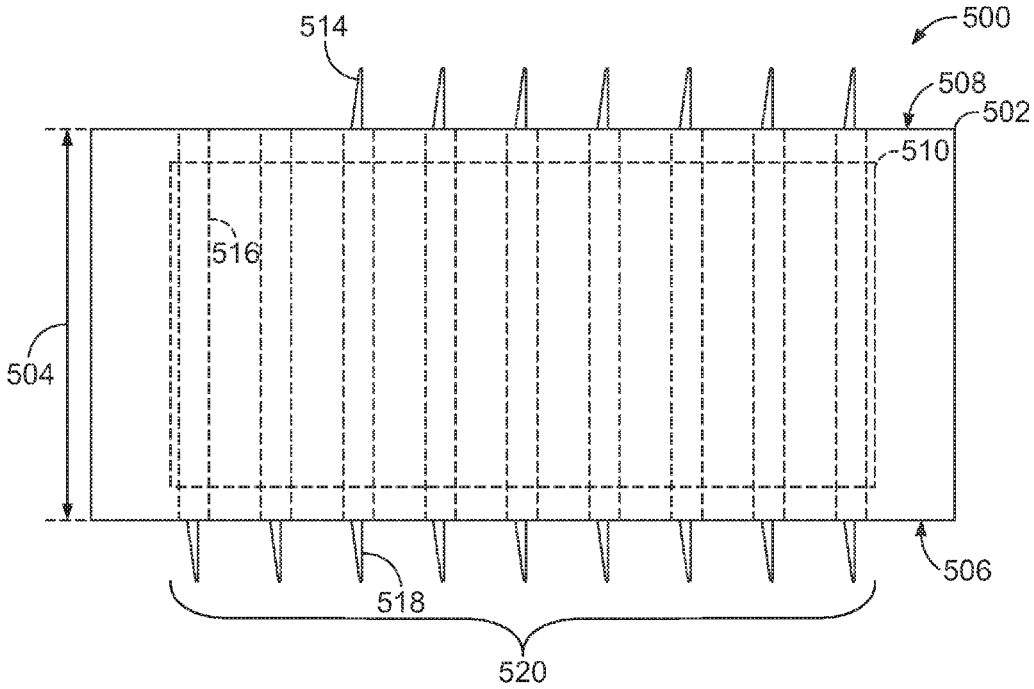
FIG. 6 is a side view of the planar inductor device shown in FIG. 5.

FIG. 5 is a top view of a planar inductor device 500 in accordance with another embodiment. FIG. 6 is a side view of the device 500. The device 500 may be similar to the device 100 shown in FIG. 1. For example, the device 500 includes a substrate 502 having a thickness dimension 504 that vertically extends from a lower surface 506 to an opposite upper surface 508. The thickness dimension 504 may be relatively small, such as 2.5 millimeters or less, 2.0 millimeters or less, 1.0 millimeters or less, or another distance. Alternatively, the thickness dimension 504 may be a larger distance. The device 500 also includes a ferrite body 510 that may be entirely disposed within the thickness dimension 504 of the substrate 502. In one embodiment, the substrate 502 may include an interior cavity, such as the cavity 120 (shown in FIG. 1) of the substrate 102 (shown in FIG. 1), with the ferrite body 510 disposed in the cavity. Conductive vias 516 extend through the thickness dimension 504 of the substrate 502.

The device 500 includes upper conductors 514 that conductively couple the vias 516 along or across the upper surface 508 of the substrate 502 and lower conductors 518 that conductively couple the vias 516 along or across the lower surface 506 of the substrate 502. Similar to the device 100, the upper conductors 514, the lower conductors 518, and the vias 516 form a conductive coil 520 that helically wraps around the ferrite body 310.

One difference between the device 100 shown in FIG. 1 and the device 500 shown in FIGS. 5 and 6 is that the upper and lower conductors 514, 518 are wires, such as wire bonds, instead of conductive layers or traces that are deposited onto the substrate 502. For example, the upper conductors 514 and/or the lower conductors 518 may be elongated strands, wires, filars, and the like, that are coupled to the vias 516. In one embodiment, the upper and/or lower conductors 514 and/or 518 may be wires that are soldered across the ferrite body 510. The upper and lower conductors 514, 518 are coupled to the vias 516 to provide the coil 520 that helically wraps around the ferrite body 510. The upper and lower conductors 514, 518 are separated from the upper and lower surfaces 508, 506 of the substrate 502 such that the upper and lower conductors 514, 518 do not contact the substrate 502. The upper and lower conductors 514, 518 may be used in place of or in addition to the upper and lower conductors 114, 118 (shown in FIG. 1) to reduce an electric resistance characteristic of the coil 520 and/or to allow for a wirebonding method to be used to provide the upper and/or lower conductors 514, 518. In one embodiment, the upper and/or lower surfaces 508, 506 of the substrate 502 can be protected with a dielectric overmold layer or similar type of material that covers the wire bonds and conductors and protects the device 500.

Figure 7:
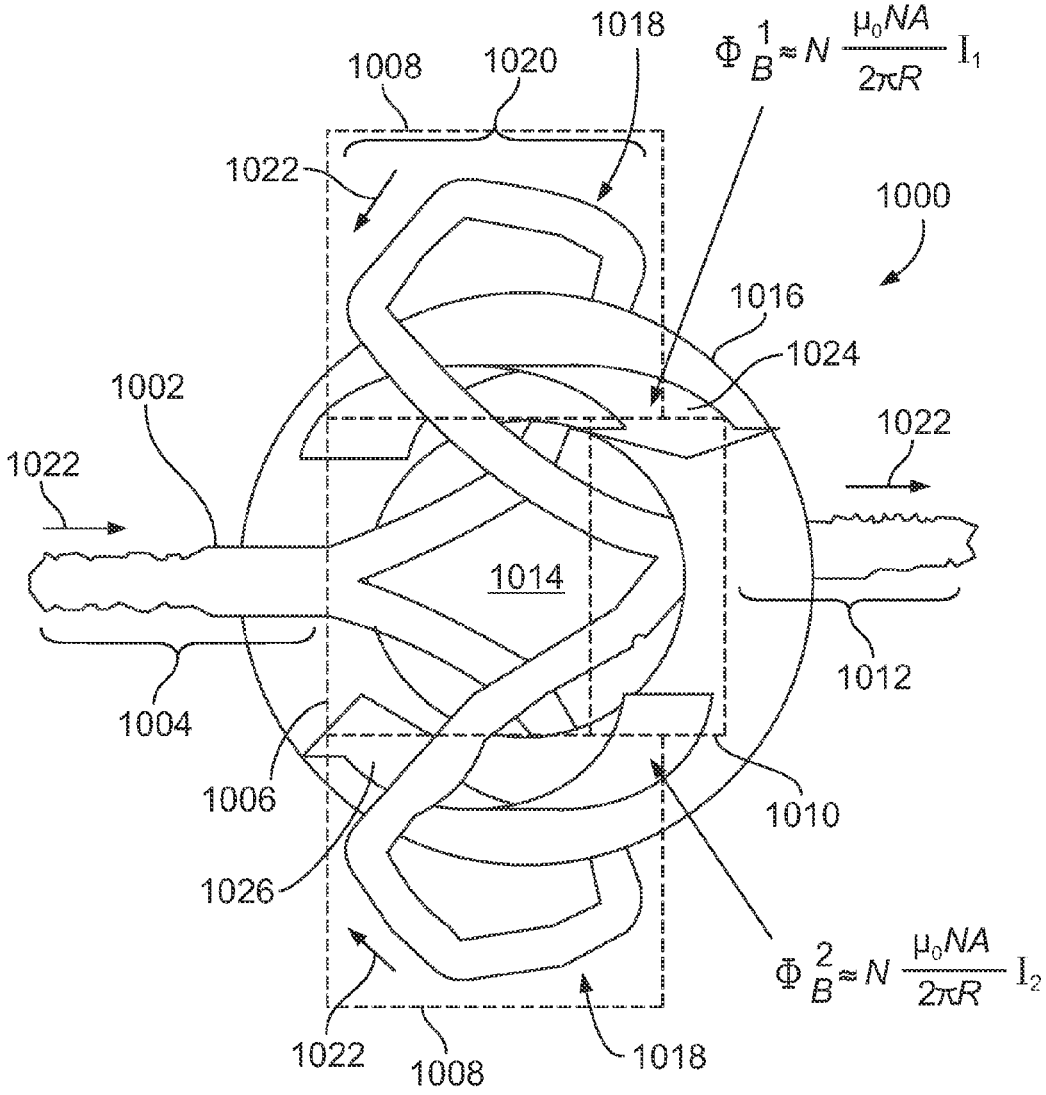
FIG. 7 is a schematic view of a planar inductor device in accordance with another embodiment.

FIG. 7 is a schematic view of a planar inductor device 1000 in accordance with another embodiment. The device 1000 includes a conductive pathway 1002 and a ferrite body 1016. In the illustrated embodiment, the ferrite body 1016 has a toroid or anulus shape such that the ferrite body 1016 extends around and encircles an opening 1014. Alternatively, the ferrite body 1016 may have another shape, such as a polygon having an opening.

The conductive pathway 1002 is shown as including a plurality of interconnected sections, including an input section 1004, a current-splitting section 1006, a coil section 1008, a current-combining section 1010, and an output section 1012. The sections 1004, 1006, 1008, 1010, 1012 may be conductively coupled with each other to form the conductive pathway 1002 through which electric current may flow from the input section 1004 to the output section 1012. In the illustrated embodiment, the input section 1004 extends to the current-splitting section 1006. The current-splitting section 1006 extends from the input section 1004 to the coil section 1008. The coil section 1008 extends from the current-splitting section 1006 to the current-combining section 1010. The current-combining section 1010 extends from the coil section 1008 to the output section 1012. The input section 1004 and the output section 1012 may be conductively coupled with an electronic circuit (e.g., the circuit 212 shown in FIG. 2) in order to provide an inductive element, such as an inductor, to the circuit. The input section 1004 may receive current from the circuit and the output section 1012 may convey the current to the circuit (or to another circuit or component).

The input section 1004 of the conductive pathway 1002 is oriented toward the opening 1014 of the ferrite body 1016. In the illustrated embodiment, the input section 1004 is disposed above the ferrite body 1016, or is disposed closer to the viewer of FIG. 7 than the ferrite body 1016. The conductive pathway 1002 splits into a plurality of conductive coils 1018 in the current-splitting section 1006, as shown in FIG. 7. While the conductive pathway 1002 is split into two coils 1018 in the illustrated embodiment, alternatively, the conductive pathway 1002 may be split into three or more coils 1018. The coils 1018 in the current-splitting section 1006 extend below the ferrite body 1016 and encircle or helically wrap around the ferrite body 1016 in the coil sections 1008.

Each of the coils 1018 may have similar or equivalent dimensions and/or be formed from the same material as the conductive pathway 1002 in the input section 1004. For example, each coil 1018 may be formed from the same material and/or have the same cross-sectional diameter as the conductive pathway 1002 in the input section 1004. Each of the coils 1018 includes a single turn 1020 around the ferrite body 1016 in the illustrated embodiment. Alternatively, one or more of the coils 1018 may wrap around the ferrite body 1016 multiple times to form multiple turns 1020 around the ferrite body 1016. The coils 1018 form parallel inductive elements of the device 1000. For example, each coil 1018 provides an inductor comprising a conductive pathway 1002 that wraps around the ferrite body 1016.

The conductive pathways 1002 in the coil sections 1008 combine with each other in the current-combining section 1010. The conductive pathways 1002 combine into a combined conductive pathway 1002 in the current-combining section 1010, with the combined conductive pathway 1002 extending below the ferrite body 1016 to the output section 1012. Alternatively, the conductive pathways 1002 in the coil section 1008 may combine into the combined conductive pathway 1002 that extends above the ferrite body 1016. The conductive pathway 1002 in the output section 1012 is oriented away from the ferrite body 1016.

In operation, the device 1000 may be used to provide an inductive element to an electric circuit. The device 1000 may have a lower electric resistance characteristic and/or a larger inductance characteristic relative to inductive elements having a single conductive pathway that wraps around a ferrite body. For example, the conductive pathway 1002 in the input section 1004 may convey an electric current (I) into the device 1000. The current (I) is divided between and conveyed along the multiple conductive pathways 1002 formed in the current-dividing section 1006. The current (I) can be divided among the multiple conductive pathways 1002 in the current-dividing section 1006 into current fractions. In the illustrated embodiment, the current (I) is divided into a first current fraction ($I_1$) and a second current fraction ($I_2$). The first and second current fractions ($I_1$, $I_2$) may be equal or approximately equal. Alternatively, the first and second current fractions ($I_1$, $I_2$) may differ from each other. The conductive pathway 1002 can be divided into more conductive pathways 1002 in the current-splitting section 1006 to further divide the current (I) into more current fractions.

The current fractions ($I_1$, $I_2$) are separately conveyed around the ferrite body 1016 by the coils 1018 of the conductive pathways 1002. Each of the current fractions ($I_1$, $I_2$) is smaller than the total current (I). For example, the current fractions ($I_1$, $I_2$) may be related to the total current (I) as follows:

$$I=I_1+I_2 \quad \text{(Equation \#1)}$$

where I represents the total current flowing through the device 1000, $I_1$ represents the first current fraction, and $I_1$ represents the second current fraction. A resistance characteristic (Ω) of the conductive pathway 1002 and/or one or more of the coils 1018 may be based on the current flowing through the conductive pathway 1002 or coils 1018 according to the following relationship:

$$R = \frac{V}{I_N} \quad \text{(Equation \#2)}$$

where R represents an electric resistance characteristic of the conductive pathway 1002 or coil 1018, such as resistance or impedance, V represents a voltage or energy characteristic of the current flowing through the conductive pathway 1002 or coil 1018, and $I_N$ represents the current (e.g., the total current (I), the first current fraction ($I_1$), or the second current fraction ($I_2$)) flowing through the corresponding conductive pathway 1002 or coil 1018).

When the total current (I) flowing through the conductive pathway 1002 is divided up into the current fractions ($I_1$, $I_2$) that separately flow through the parallel coils 1018, the resistance characteristic (R) of each of the coils 1018 can decrease relative to the conductive pathway 1002. For example, the resistance for the current (I) flowing through the conductive pathway 1002 may be halved, or reduced by up to 50%, for the first and/or second current ($I_1$, $I_2$) flowing through the parallel first and second coils 1018. Reducing the resistance characteristic (R) in the coils 1018 can reduce power losses in the current (I) as the current (I) flows through the device 1000. As described below, the resistance characteristic (R) can be decreased in the device 1000 without an accompanying loss in an inductance characteristic (L) of the device 1000.

Arrows 1022 indicate the direction in which the current (I) and current fractions ($I_1$, $I_2$) flow through the device 1000. As the current fractions ($I_1$, $I_2$) flow around the ferrite body 1016, the current fractions ($I_1$, $I_2$) generate first and second magnetic fluxes ($\Phi_{B1}$, $\Phi_{B2}$) in the ferrite body 1016. The magnetic fluxes ($\Phi_{B1}$, $\Phi_{B2}$) may be based on a number of factors, such as the number of turns 1020 (N) of the coils 1018 around the ferrite body 1016, the magnetic permeability ($\mu_0$) of the ferrite body 1016, the cross-sectional area (A) of the conductive pathways 1002 within the coils 1018, the radius (R) of the turn 1020 formed by the coil 1018, and the current fractions ($I_1$, $I_2$) flowing through the coils 1018. In one embodiment, the magnetic fluxes ($\Phi_{B1}$, $\Phi_{B2}$) may be based on the following relationships:

$$\Phi_B^1 \approx N \cdot \frac{\mu_0 NA}{2\pi R} \cdot I_1 \quad \text{(Equation \#3)}$$

$$\Phi_B^2 \approx N \cdot \frac{\mu_0 NA}{2\pi R} \cdot I_2 \quad \text{(Equation \#4)}$$

where $\Phi_B{}^1$ represents the first magnetic flux, $\Phi_B{}^2$ represents the second magnetic flux, N represents the number of turns 1020 around the ferrite body 1016, A represents the cross-sectional area of the conductive pathway 1002 in the coil 1018, R represents the radius of curvature of the coil 1018, $\mu_0$ represents the magnetic permeability of the ferrite body 1016, $I_1$ represents the first current fraction, and $I_2$ represents the second current fraction. The above equations may represent approximations of the magnetic fluxes ($\Phi_{B1}$, $\Phi_{B2}$) and not actual relationships used to determine an exact value of the magnetic fluxes ($\Phi_{B1}$, $\Phi_{B2}$). For example, Equations #1 and 2 may indicate which terms in the Equations are proportional, inversely proportional, and the like, with the magnetic fluxes ($\Phi_{B1}$, $\Phi_{B2}$).

The directions in which the magnetic fluxes ($\Phi_{B1}$, $\Phi_{B2}$) flow in the ferrite body 1016 are based on the direction of flow of the current fractions ($I_1$, $I_2$) through the coils 1018 of the conductive pathways 1002. For example, as shown in FIG. 7, the first magnetic flux ($\Phi_{B1}$) generated by the first current fraction ($I_1$) is oriented in the direction of arrow 1024 while the second magnetic flux ($\Phi_{B2}$) generated by the second current fraction ($I_2$) is oriented in the direction of the arrow 1026. Due to the direction of current flow and the directions in which the coils 1018 wrap around the ferrite body 1016, the magnetic fluxes ($\Phi_{B1}$, $\Phi_{B2}$) are additive. For example, the magnetic fluxes ($\Phi_{B1}$, $\Phi_{B2}$) may add together and increase a total magnetic flux ($\Phi_B$) of the device 1000, rather than decrease the total magnetic flux ($\Phi_B$) of the device 1000. The total magnetic flux ($\Phi_B$) of the device 1000 may be represented by the following relationship:

$$\Phi_B=\Phi_B{}^1+\Phi_B{}^2 \quad \text{(Equation \#5)}$$

where $\Phi_B$ represents the total magnetic flux, $\Phi_B{}^1$ represents the first magnetic flux, and $\Phi_B{}^2$ represents the second magnetic flux.

The device 1000 can provide an inductor having an inductance characteristic (L). The inductance characteristic (L) represents the magnetic energy generated by the device 1000 when the current (I) flows through the device 1000. In one embodiment, the inductance characteristic (L) of the device 1000 is represented by the following relationship:

$$L = \frac{\Phi_B}{I} \quad \text{(Equation \#5)}$$

where L represents the inductance characteristic of the device 1000, I represents the current flowing through the conductive pathways 1002 of the device 1000, and $\Phi_B$ represents the total magnetic flux generated in the ferrite body 1016 of the device 1000 caused by the flow of current (I) through the device 1000.

As described above, a resistance characteristic (R) of the device 1000 can be reduced by providing a plurality of the parallel coils 1018 and dividing the current (I) into divided currents ($I_1$, $I_2$) that separately flow through the parallel coils

1018. The resistance characteristic (R) can represent the total electric impedance or resistance of the conductive pathway 1002 and coils 1018 in the device 1000. The resistance characteristic (R) can be reduced relative to other inductors or inductive elements having the same or approximately the same inductance characteristic (L) as the device 1000. For example, the device 1000 may have approximately the same inductance, but a lower resistance, as another device having a single conductive pathway 1002 that does not include parallel coils 1018 but helically wraps around the ferrite body 1016 for a single turn 1020. The parallel coils 1018 enable the device 1000 to provide the same or approximately the same inductance characteristic (L) without an increase or significant increase in the resistance characteristic (R) of the device 1000.

Figure 8:
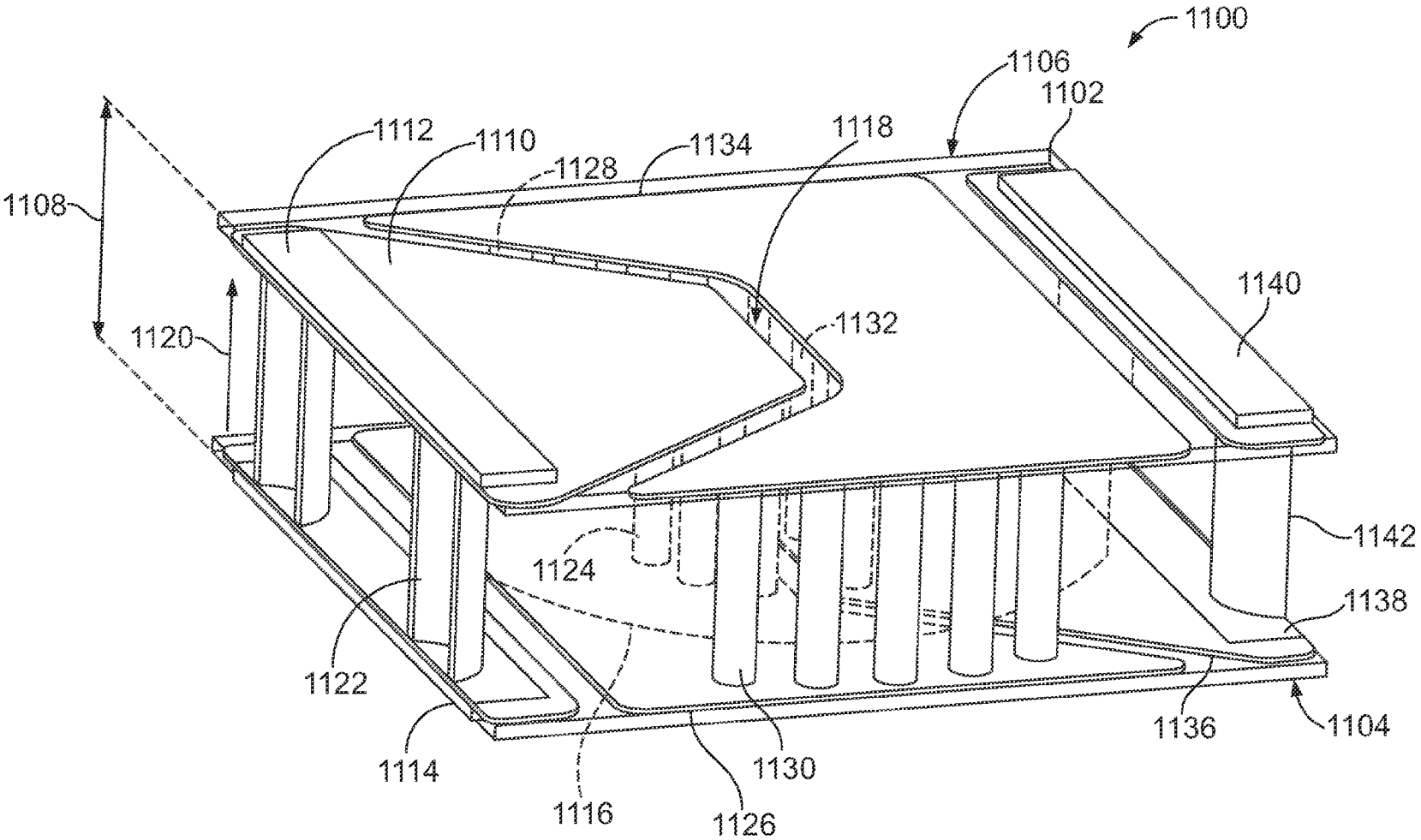
FIG. 8 is a perspective view of a planar inductor device in accordance with another embodiment.
Figure 9:
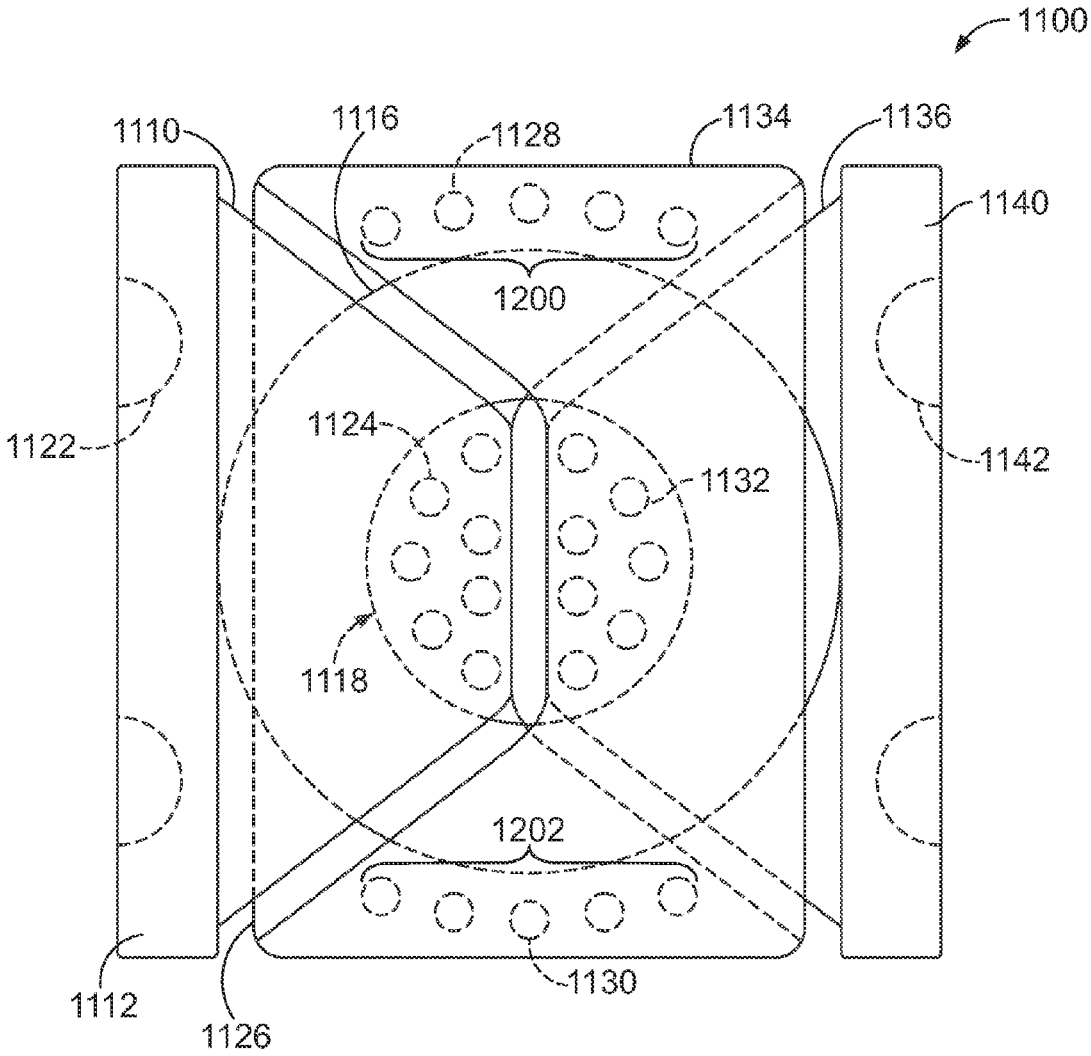
FIG. 9 is a top view of the planar inductor device shown in FIG. 8.

FIG. 8 is a perspective view of a planar inductor device 1100 in accordance with another embodiment. FIG. 9 is a top view of the device 1100. The device 1100 may be similar to the device 1000 that is schematically shown in FIG. 7. For example, the device 1100 may include a conductive pathway that extends toward a ferrite body, includes or is divided into parallel coils that helically wrap around the ferrite body, and recombines the parallel coils into the conductive pathway that extends out of the ferrite body.

In the illustrated embodiment, the device 1100 is embedded within a planar substrate 1102 (shown in FIG. 8). The substrate 1102 may be a flexible and non-rigid sheet, such as a sheet of cured epoxy, or a rigid or semi-rigid board, such as a printed circuit board (PCB) formed of FR-4. The substrate 1102 is shown in phantom view in FIG. 8 and is not shown in FIG. 9. The substrate 1102 vertically extends from a lower surface 1104 (shown in FIG. 8) to an opposite upper surface 1106 (shown in FIG. 8). The substrate 1102 has a thickness dimension 1108 (shown in FIG. 8) that is measured from the lower surface 1104 to the upper surface 1106 along a vertical direction 1120 (shown in FIG. 8) that is oriented perpendicular to the upper surface 1106. The thickness dimension 1108 may be relatively small, such as 2.5 millimeters or less, 2.0 millimeters or less, 1.0 millimeters or less, or another distance. Alternatively, the thickness dimension 1108 may be a larger distance.

The device 1100 includes an input conductor 1110 that receives electric current into the device 1100. In the illustrated embodiment, the input conductor 1110 is formed as a planar conductive body. The input conductor 1110 may be deposited as a planar conductive trace on one or more sub-layers of the substrate 1102 (shown in FIG. 8) that are disposed between the upper surface 1106 (shown in FIG. 8) and the lower surface 1104 (shown in FIG. 8). A conductive bus 1112 and/or a conductive bus 1114 (shown in FIG. 8) may be coupled with the input conductor 1110 and exposed at or along the upper surface 1106 and the lower surface 1104, respectively, of the substrate 1102. Conductive vias 1122 can couple the buses 1112, 1114 with each other. Multiple vias 1122 can be added to reduce electrical resistance for the device 1100. In some instances, the vias 1122 can be filled with thermally conductive paste or electrically conductive paste to reduce electrical resistance and/or increase thermal conductivity of the device 1100. Alternatively, the input conductor 1110 may be located on the upper surface 1106 or lower surface 1104 of the substrate 1102. The conductive bus 1112 and/or 1114 may receive electric current from an electric circuit, such as from a wire or other conductive body that is coupled with the circuit, and convey the current to the input conductor 1110.

A ferrite body 1116 is disposed within the substrate 1102 in the illustrated embodiment. The ferrite body 1116 is shown in phantom in FIG. 8. The ferrite body 1116 can be entirely located within the substrate 1102 such that no part of the ferrite body 1116 extends above or projects through a plane defined by the upper surface 1106 (shown in FIG. 8) of the substrate 1102 and/or a plane defined by the lower surface 1104 of the substrate 1102 (shown in FIG. 8). The ferrite body 1116 can have a toroid or anulus shape similar to the shape of the ferrite body 1016 shown in FIG. 7. Alternatively, the ferrite body 1116 can have a different shape. The ferrite body 1116 includes an opening 1118 that is similar to the opening 1014 of the ferrite body 1016 shown in FIG. 7.

As shown in FIG. 9, the input conductor 1110 extends above the ferrite body 1116 and at least a portion of the opening 1118 in the ferrite body 1116. For example, at least part of the input conductor 1110 may be located between the ferrite body 1116 and the upper surface 1106 (shown in FIG. 8) of the substrate 1102 (shown in FIG. 8) along or parallel to the vertical direction 1120 (shown in FIG. 8) and at least part of the input conductor 1110 may be between the opening 1118 and the upper surface 1106 of the substrate 1102 along the vertical direction 1120. Alternatively, at least part of the input conductor 1110 may be located between the ferrite body 1116 and the lower surface 1104 (shown in FIG. 8) of the substrate 1102 along or parallel to the vertical direction 1120 and at least part of the input conductor 1110 may be between the opening 1118 and the lower surface 1104 of the substrate 1102 along the vertical direction 1120.

One or more conductive input vias 1124 are coupled with the input conductor 1110. The input vias 1124 include holes or channels that extend through the substrate 1102 (shown in FIG. 8) that are plated or substantially filled with a conductive material (e.g., a metal, metal alloy, or conductive solder). As shown in FIG. 9, the input vias 1124 are disposed within the opening 1118 of the ferrite body 1116. In the illustrated embodiment, the device 1100 includes seven input vias 1124. Alternatively, a smaller or larger number of input vias 1124 may be provided. The input vias 1124 can vertically extend through the substrate 1102 from the input conductor 1110 toward the lower surface 1104 (shown in FIG. 8) of the substrate 1102. In the illustrated embodiment, the input conductor 1110 and the input vias 1124 can provide a portion of the conductive pathway 1002 that is represented by the input section 1004 in FIG. 7. For example, the input conductor 1110 and the input vias 1124 may provide a conductive pathway that extends toward and into the opening 1118 of the ferrite body 1116. The input conductor 1110 and the input vias 1124 may convey the electric current (I) described above in connection with FIG. 7 into the device 1100.

The device 1100 includes a current-splitting conductor 1126 that is conductively coupled with the input vias 1124. The input vias 1124 conductively couple the input conductor 1110 with the current-splitting conductor 1126. In the illustrated embodiment, the current-splitting conductor 1126 is formed as a planar conductive body. The current-splitting conductor 1126 may be deposited as a planar conductive trace on one or more sub-layers of the substrate 1102 (shown in FIG. 8) that are disposed between the upper surface 1106 (shown in FIG. 8) and the lower surface 1104 (shown in FIG. 8). Alternatively, the current-splitting conductor 1126 may be located on the upper surface 1106 or lower surface 1104 of the substrate 1102.

In the illustrated embodiment, the current-splitting conductor 1126 extends below the ferrite body 1116 and at least a portion of the opening 1118 in the ferrite body 1116. For example, at least part of the current-splitting conductor 1126 may be located between the ferrite body 1116 and the lower surface 1104 (shown in FIG. 8) of the substrate 1102 (shown in FIG. 8) along or parallel to the vertical direction 1120 (shown in FIG. 8) and at least part of the current-splitting conductor 1126 may be between the opening 1118 and the lower surface 1104 of the substrate 1102 along the vertical direction 1120. As shown in FIG. 8, the input conductor 1110 and the current-splitting conductor 1126 are disposed on opposite sides of the ferrite body 1116.

One or more conductive current-splitting vias 1128, 1130 are coupled with the current-splitting conductor 1126. The current-splitting vias 1128, 1130 include holes or channels that extend through the substrate 1102 (shown in FIG. 8) and that are plated or substantially filled with a conductive material (e.g., a metal, metal alloy, or conductive solder). As shown in FIG. 9, the current-splitting vias 1128, 1130 are disposed outside of the ferrite body 1116. For example, the current-splitting vias 1128, 1130 are not located inside the opening 1118 of the ferrite body 1116 in the illustrated embodiment. The current-splitting vias 1128 are grouped in a first set 1200 (shown in FIG. 9) on one side of the ferrite body 1116 while the current-splitting vias 1130 are grouped in a different second set 1202 (shown in FIG. 9) that is spaced apart from the first set 1200 on the opposite side of the ferrite body 1116. As shown in FIG. 9, the first and second sets 1200, 1202 may include non-overlapping groups of the current-splitting vias 1128, 1130. For example, the first and second sets 1200, 1202 may not share or include one or more of the same current-splitting vias 1128, 1130. Alternatively, the current-splitting vias 1128 and/or 1130 may be grouped into a different number of sets 1200, 1202.

In the illustrated embodiment, the device 1100 includes ten current-splitting vias 1128, 1130 with five current-splitting vias 1128 or 1130 in each set 1200, 1202 (shown in FIG. 9) disposed on opposite sides of the ferrite body 1116. Alternatively, a different number of current-splitting vias 1128 and/or 1130 may be provided. The current-splitting vias 1128, 1130 vertically extend through the substrate 1102 (shown in FIG. 8) from the current-splitting conductor 1126 toward the upper surface 1106 (shown in FIG. 8) of the substrate 1102. In the illustrated embodiment, the current-splitting conductor 1126 and the current-splitting vias 1128, 1130 can provide a portion of the conductive pathway 1002 (shown in FIG. 7) that is represented by the current-splitting section 1006 in FIG. 7. For example, the current-splitting conductor 1126 and the current-splitting vias 1128, 1130 may provide the plurality of conductive pathways 1002 that are coupled with and split off of the conductive pathway 1002 in the input section 1004 of FIG. 7. The current-splitting conductor 1126 and the current-splitting vias 1128, 1130 may divide the electric current (I) received from the input conductor 1110 and the input vias 1124 into the first and second current fractions ($I_1$ and $I_2$).

The device 1100 includes a current-combining conductor 1134 that is conductively coupled with the separate sets 1200, 1202 (shown in FIG. 9) of the current-splitting vias 1128, 1130. The current-splitting vias 1128, 1130 conductively couple the current-splitting conductor 1126 with the current-combining conductor 1134. In the illustrated embodiment, the current-combining conductor 1134 is formed as a planar conductive body. The current-combining conductor 1134 may be deposited as a planar conductive trace on one or more sub-layers of the substrate 1102 (shown in FIG. 8) that are disposed between the upper surface 1106 (shown in FIG. 8) and the lower surface 1104 (shown in FIG. 8). Alternatively, the current-combining conductor 1134 may be located on the upper surface 1106 or lower surface 1104 of the substrate 1102.

In the illustrated embodiment, the current-combining conductor 1134 extends above the ferrite body 1116 and at least a portion of the opening 1118 in the ferrite body 1116. For example, at least part of the current-combining conductor 1134 may be located between the ferrite body 1116 and the upper surface 1106 (shown in FIG. 8) of the substrate 1102 (shown in FIG. 8) along or parallel to the vertical direction 1120 (shown in FIG. 8) and at least part of the current-combining conductor 1134 may be between the opening 1118 and the upper surface 1106 of the substrate 1102 along the vertical direction 1120. As shown in FIG. 8, the current-splitting conductor 1126 and the current-combining conductor 1134 are disposed on opposite sides of the ferrite body 1116.

One or more conductive current-combining vias 1132 are coupled with the current-combining conductor 1134 and the current-splitting conductor 1126. The current-combining vias 1132 include holes or channels that extend through the substrate 1102 (shown in FIG. 8) and that are plated or substantially filled with a conductive material (e.g., a metal, metal alloy, or conductive solder). As shown in FIG. 9, the current-combining vias 1132 are disposed inside the ferrite body 1116. For example, the current-combining vias 1132 are located inside the opening 1118 of the ferrite body 1116. In the illustrated embodiment, the device 1100 includes seven current-combining vias 1132. Alternatively, a different number of current-combining vias 1132 may be provided.

In one embodiment, holes or interior cavities in the substrate 1102 (shown in FIG. 8) are preformed or premade. For example, the holes or cavities may be formed when the substrate 1102 is created. The holes or cavities can include posts that are positioned and shaped within the holes or cavities for the ferrite body 1116 to reside on. The ferrite body 1116 can be mechanically shaken into position within the substrate 1102 and on top of the post in a hole or cavity by using a tapered insert that guides the ferrite body 1116 into the hole. Alternatively, the ferrite body 1116 can be placed into the hole and on the post with a pick-and-place machine. The post can provide a supporting framework for the structure. In one embodiment, a low stress or ultra low-stress material, such as silicone, can be inserted into the hole or cavity and surround the ferrite body 1116. In one embodiment, if the device 1110 is used for relatively high voltage and/or current applications, a special grade material may be used for substrate and/or post. The material can have relatively low amounts of halogens and/or be relatively glass bundle-free for increased reliability, as well as providing an encapsulation around the ferrite body 1116 that is hermetic or near hermetic. Examples of such a material can include liquid crystalline polymer (LCP) and/or teflon. The vias 1132 can extend through the substrate 1102 and/or the low-stress material around the ferrite body 1116 and may carry relatively large amounts of electric power. The substrate 1102 can provide relatively high electric isolation between the vias 1132 even in the presence of moisture and high temperatures.

The current-combining conductor 1134 and the current-combining vias 1132 can provide a portion of the conductive pathway 1002 (shown in FIG. 7) that is represented by the current-combining section 1010 in FIG. 7. For example, the current-combining conductor 1134 and the current-combining vias 1132 may combine the first and second current fractions ($I_1$, $I_2$) that are separately conveyed through the current-splitting vias 1128, 1130 around the ferrite body 1116 to the current-combining conductor 1134.

The device 1100 includes an output conductor 1136 that receives the current (I) that is combined from the first and second current fractions ($I_1$, $I_2$) by the current-combining conductor 1134. In the illustrated embodiment, the output conductor 1136 is formed as a planar conductive body. The output conductor 1136 may be deposited as a planar conductive trace on one or more sub-layers of the substrate 1102 (shown in FIG. 8) that are disposed between the upper surface 1106 (shown in FIG. 8) and the lower surface 1104 (shown in FIG. 8).

As shown in FIG. 9, the output conductor 1136 extends below the ferrite body 1116 and at least a portion of the opening 1118 in the ferrite body 1116. For example, at least part of the output conductor 1136 may be located between the ferrite body 1116 and the lower surface 1104 (shown in FIG. 8) of the substrate 1102 (shown in FIG. 8) along or parallel to the vertical direction 1120 (shown in FIG. 8) and at least part of the output conductor 1136 may be between the opening 1118 and the lower surface 1104 of the substrate 1102 along the vertical direction 1120. Alternatively, at least part of the output conductor 1136 may be located between the ferrite body 1116 and the upper surface 1106 (shown in FIG. 8) of the substrate 1102 along or parallel to the vertical direction 1120 and at least part of the output conductor 1136 may be between the opening 1118 and the upper surface 1106 of the substrate 1102 along the vertical direction 1120.

A conductive bus 1138 and/or a conductive bus 1140 (shown in FIG. 8) may be coupled with the output conductor 1136 and exposed at or along the lower surface 1104 and the upper surface 1106, respectively, of the substrate 1102. Conductive vias 1142 can couple the buses 1138, 1140 with each other. Alternatively, the output conductor 1136 may be located on the upper surface 1106 or lower surface 1104 of the substrate 1102. The conductive bus 1138 and/or 1140 outputs the electric current (I) that is combined from the first and second current fractions ($I_1$, $I_2$) from the device 1100. A circuit may be conductively coupled with one or more of the busses 1138, 1140 to receive the combined current (I).

In operation, the device 1100 receives electric current (I) from an electric circuit and conveys the current (I) along the input conductor 1110 to the input vias 1124. The input vias 1124 convey the current (I) through the opening 1118 in the ferrite body 1116. The current (I) flows through the input vias 1124 to the current-splitting conductor 1126. The current-splitting conductor 1126 divides the current (I) into the first and second current fractions ($I_1$, $I_2$). The first current fraction ($I_1$) is conveyed by the first set 1200 of current-splitting vias 1128 outside of the ferrite body 1116 and the second current fraction ($I_2$) is conveyed by the second set 1202 of current-splitting vias 1130 outside of the ferrite body 1116. The current-splitting vias 1128, 1130 conduct the current fractions ($I_1$, $I_2$) to the current-combining conductor 1134. The flow of the current fractions ($I_1$, $I_2$) through the current-splitting conductor 1126 and the current-splitting vias 1128, 1130 to the current-combining conductor 1134 approximately follows the flow of current through coils that helically encircle the ferrite body 1116. The current fractions ($I_1$, $I_2$) are received by the current-combining conductor 1134 and combined into the current (I). The current (I) is conveyed from the current-combining conductor 1134 to the output conductor 1136 by the current-combining vias 1132.

Figure 10:
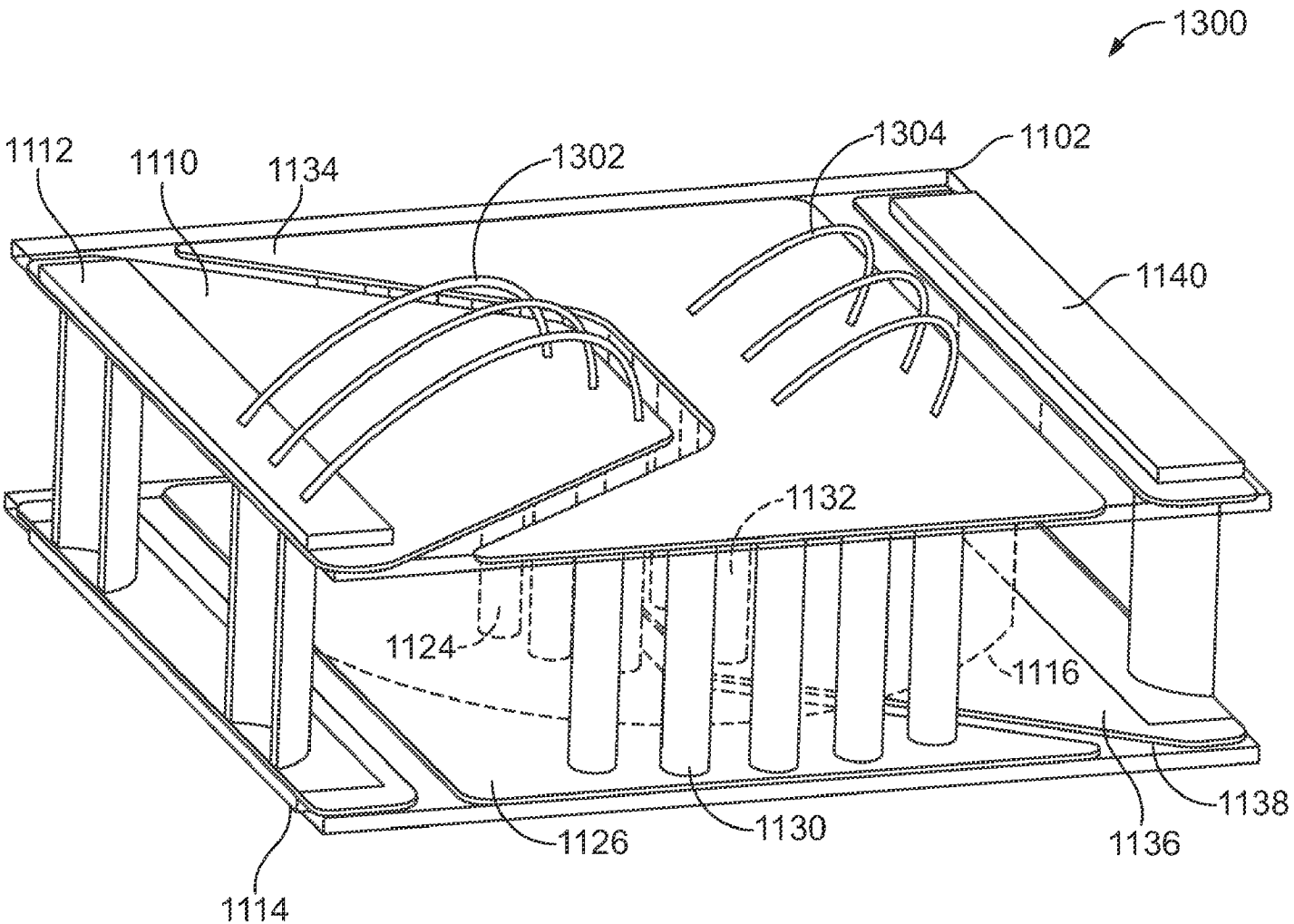
FIG. 10 is a perspective view of a planar inductor device in accordance with another embodiment.

FIG. 10 is a perspective view of a planar inductor device 1300 in accordance with another embodiment. The device 1300 may be similar to the device 1100 shown in FIGS. 8 and 9. For example, the device 1300 may include the busses 1112, 1114, 1138, 1140, the conductors 1110, 1126, 1134, 1136, the vias 1124, 1128 (shown in FIG. 9), 1130, 1132, and/or the ferrite body 1116 embedded in the substrate 1102. One difference between the device 1100 and the device 1300 is that the device 1300 may include additional conductive pathways 1302, 1304. In the illustrated embodiment, the conductive pathways 1302, 1304 represent wires that are coupled with the device 1300 by wire bonding. Alternatively, the conductive pathways 1302, 1304 may represent other conductors, such as conductive traces, busses, and the like.

The conductive pathways 1302 are coupled with the bus 1112 and one or more of the input conductor 1110 and/or the input vias 1124. In one embodiment, the conductive pathways 1302 are wire bonds that are coupled to the bus 1112 and the interfaces between the input conductor 1110 and the input vias 1124. The conductive pathways 1302 provide additional pathways for the current (I) to be conveyed from the bus 1112 to the input vias 1124. As shown in FIG. 10, current (I) that is received by the bus 1112 can be conveyed to the input vias 1124 by the input conductor 1110 and the conductive pathways 1302. Providing the conductive pathways 1302 can reduce the resistance of the path that the current (I) experiences and/or power losses that may otherwise occur when the current (I) flows to the input vias 1124. Although not shown in FIG. 10, conductive pathways that are similar to the conductive pathways 1302 and/or 1304 may be joined to one or more of the conductors 1126, 1136, The conductive pathways 1304 are coupled with the current-combining conductor 1134 in a plurality of locations. For example, the conductive pathways 1304 may be coupled to the interfaces between the current-combining conductor 1134 and the current-combining vias 1132 and coupled to the current-combining conductor 1134 in locations that are spaced apart from the interfaces between the current-combining conductor 1134 and the current-combining vias 1132. The conductive pathways 1304 provide additional pathways for the current fractions ($I_1$, $I_2$) to be conveyed from the current-combining conductor 1134 to the current-combining vias 1132. Providing the conductive pathways 1304 can reduce the resistance of the path that the current fractions ($I_1$, $I_2$) experience and/or power losses that may otherwise occur when the current fractions ($I_1$, $I_2$) are combined into the current (I) by the current-combining conductor 1134 and/or the current-combining vias 1132.

Figure 21:
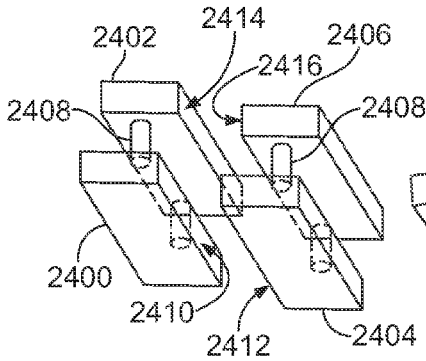
FIGS. 21 through 23 illustrate different techniques for conductively coupling conductors and/or conductive layers in one or of the embodiments described herein.
Figure 22:
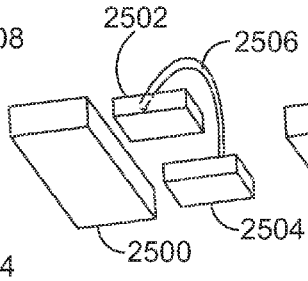
Figure 23:
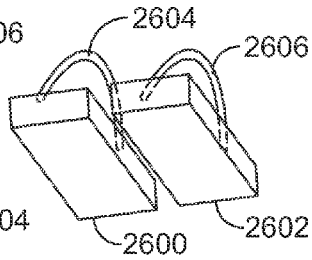

FIGS. 21 through 23 illustrate different techniques for conductively coupling conductors and/or conductive layers in one or of the embodiments described herein. For example, the techniques illustrated in FIGS. 21 through 23 may be used to conductively couple two or more of the conductors 1110, 1126, 1134, 1136 (shown in FIG. 8) of the device 1100 (shown in FIG. 8) and/or of the device 1300 (shown in FIG. 10).

With respect to FIG. 21, conductive layers or conductors 2400, 2402 and conductive layers or conductors 2404, 2406 are coupled with each other using conductive microvias 2408. In another embodiment, conductive couplings between conductive layers or conductors 2400, 2402 and/or between conductive layers or conductors 2404, 2406 disposed on different layers of a substrate can represent portions of through holes that extend through the entire thickness of the substrate. The view shown in FIG. 21 is an exploded view with the conductors 2400, 2402 separated from the conductors 2404, 2408. The conductors 2400, 2404 may be edge-coupled conductors that are joined along edges 2410, 2412 that face each other and the conductors 2402, 2406 may be edge-coupled and/or offset broadside coupled conductors that are joined along edges 2414, 2416 that face each other. The coupling of the conductors 2400, 2402 and of the conductors 2404, 2406 with the microvias 2408 can increase the amount of electric current that may be conveyed using the conductors 2400, 2402, 2404, 2406 and/or can modify inductive coupling between the conductors 2400, 2402, 2404, 2406.

With respect to FIG. 22, conductive layers or conductors 2500, 2502, 2504 are conductively coupled in a plurality of manners. The view shown in FIG. 22 is an exploded view with the conductors 2502, 2504 separated from the conductor 2500. For example, the conductor 2500 can be edge-coupled with the conductors 2502, 2504. The conductors 2502, 2504 are conductively coupled with each other by a wire bond 2506.

With respect to FIG. 23, conductive layers or conductors 2600, 2602 are edge-coupled conductors. The view shown in FIG. 23 is an exploded view with the conductors 2600, 2602 separated from each other. Each of the conductors 2600, 2602 includes a wire bond 2604, 2606 that is coupled with the corresponding conductor 2600, 2602 in a plurality of locations. The addition of the wire bonds 2604, 2606 can increase the current-carrying capability of the conductors 2600, 2602.

Figure 11:
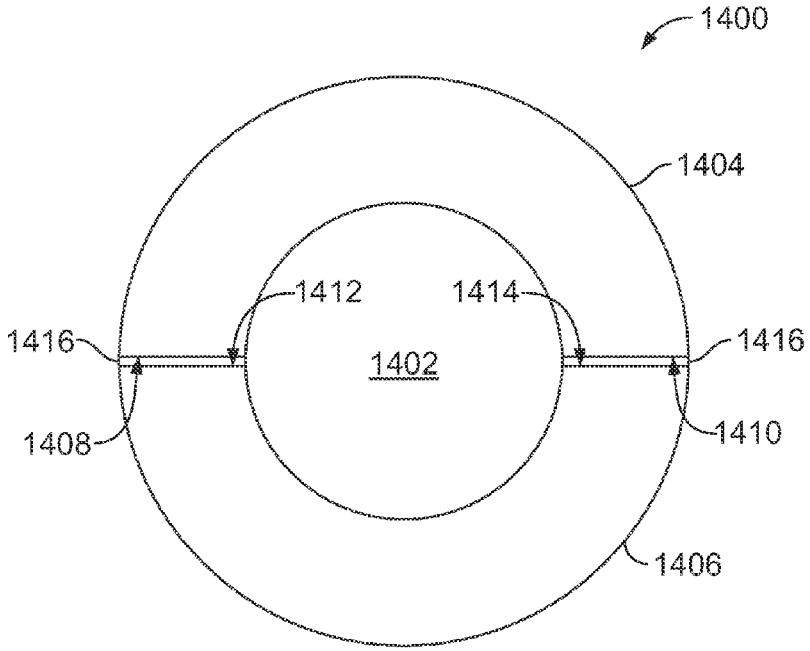
FIG. 11 is a top view of a ferrite body in accordance with one embodiment.

FIG. 11 is a top view of a ferrite body 1400 in accordance with one embodiment. The ferrite body 1400 may be used as the ferrite body in one or more embodiments described herein. For example, the ferrite body 1400 may be used as the ferrite body 110 (shown in FIG. 1), the ferrite body 310 (shown in FIG. 3), the ferrite body 510 (shown in FIG. 5), the ferrite body 1016 (shown in FIG. 7), or the ferrite body 1116 (shown in FIG. 8). With respect to the ferrite bodies 110, 310, 510, these bodies 110, 310, 510 may represent a section or portion of the ferrite body 1400. For example, one or more of the ferrite bodies 110, 310, 510 may represent a subsection of the ferrite body 1400 shown in FIG. 11.

The ferrite body 1400 may include, or be formed from, a metal and/or a magnetic material. In one embodiment, the ferrite body 1400 includes, or is formed from, a relatively soft ferrite such as NiZn or MnZn. Alternatively, a different metal or metal alloy may be used. The ferrite body 1400 has a toroid or anulus shape that encircles a central opening 1402 in the illustrated embodiment. Alternatively, the ferrite body 1400 may have another shape. The ferrite body 1400 is divided into a plurality of sections 1404, 1406. For example, the ferrite body 1400 may have two U-shaped sections 1404, 1406, with the section 1404 extending along an arcuate path between opposite ends 1408, 1410 and the section 1406 extending along an arcuate path between opposite ends 1412, 1414.

In the illustrated embodiment, the ends 1408, 1410 of the section 1404 face the ends 1412, 1414 of the section 1406. The ends 1408 and 1412 and the ends 1410 and 1414 are separated from each other by a buffer layer 1416. The buffer layers 1416 separate the sections 1404, 1406 from each other. The buffer layers 1416 may be formed from a non-conductive and/or non-magnetic material. For example, the buffer layers 1416 may be formed from dielectric materials, such as epoxy.

The buffer layers 1416 can separate the ferrite body 1400 into the sections 1404, 1406 to reduce saturation of the ferrite body 1400. For example, when one or more conductive coils helically wrap around the ferrite body 1400 and convey current around the ferrite body 1400 (such as in one or more of the devices 100, 300, 500, 1000, 1100, 1300 shown and described above), the current may generate sufficiently high magnetic flux in the ferrite body 1400 that the ferrite body 1400 becomes saturated. The ferrite body 1400 may be saturated when further increases in the electric current that is conveyed in conductive coils encircling the ferrite body do not result in a corresponding increase in the magnetic flux in the ferrite body 1400. The buffer layers 1416 separate the sections 1404, 1406 of the ferrite body 1400 such that magnetic flux in the ferrite body 1400 cannot flow between the sections 1404, 1406. As a result, the magnetic flux in the ferrite body 1400 may be decreased for relatively large current flowing around the ferrite body 1400.

In one embodiment, the ferrite body 1400 is cut into the sections 1404, 1406 after the ferrite body 1400 is disposed within a substrate. For example, after an electric circuit is formed that includes a conductive coil helically wrapped around the ferrite body 1400, a punch machine or saw plate can be used to cut through a portion of ferrite body 1400 that is already embedded in a substrate with relatively high precision and accuracy. There can be one or numerous cuts through the ferrite body 1400. For example, the ferrite body 1400 may be embedded into a substrate in a manner as described in U.S. patent application Ser. No. 13/028,949, which is entitled "Planar Electronic Device Having A Magnetic Component And Method For Manufacturing The Electronic Device" and was filed on 16 Feb. 2011 (referred to herein as the "'949 Application"). The entire disclosure of the '949 Application is incorporated by reference herein in its entirety. In connection with the description of the '949 Application, the ferrite body 1400 may be embedded in the encapsulating material 304 of the substrate 104 of the '949 Application in a manner similar to the ferrite body 200 of the '949 Application.

In another embodiment, mechanically pressure may be applied to the substrate that includes the ferrite body 1400 to create cracks or fractures in the ferrite body 1400. For example, pressure may be applied to provide enough force that the ferrite body 1400 develops a fixed amount of hairline cracks through the ferrite body 1400. Because the ferrite body 1400 is a continuous shape in the illustrated embodiment, the application of pressure may develop cracks on opposite ends of the ferrite body 1400 to convert the ferrite body 1400 from a continuous to non-continuous body.

Figure 12:
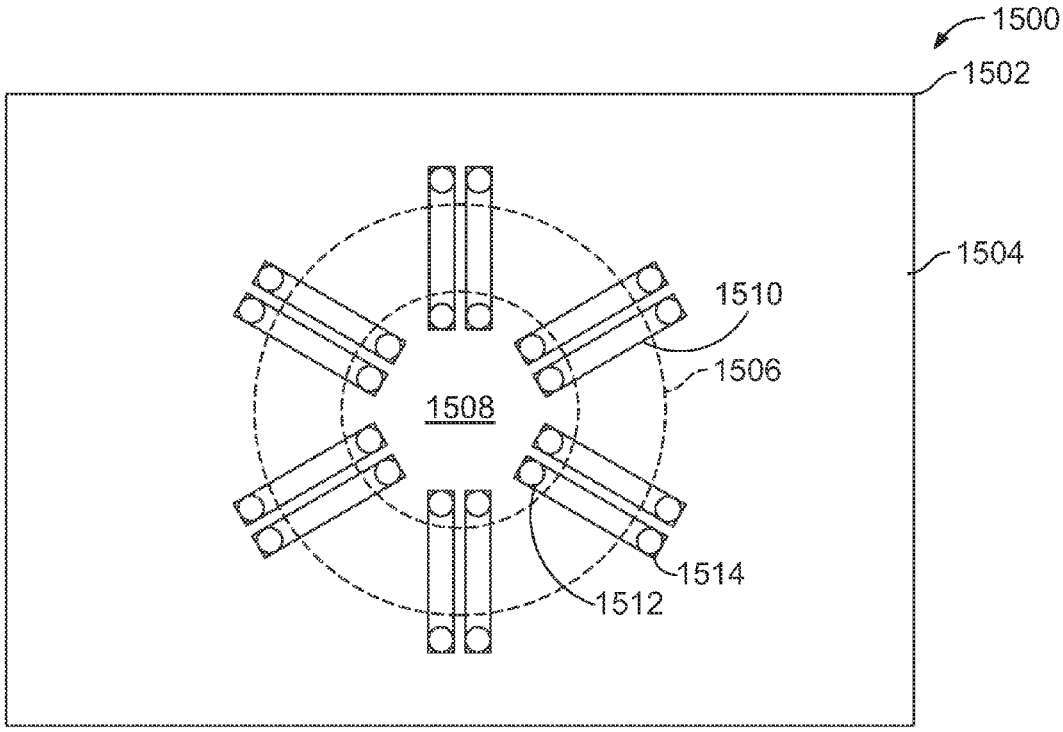
FIG. 12 is a top view of a multilayer planar inductor device in accordance with one embodiment.

FIG. 12 is a top view of a multilayer planar inductor device 1500 in accordance with one embodiment. Similar to the substrate 102 (shown in FIG. 1) of the device 100 (shown in FIG. 1), the device 1500 includes a substrate 1502 having a thickness dimension that vertically extends from a lower surface (not shown in FIG. 12) that is similar to the lower surface 106 (shown in FIG. 1) to an opposite upper surface 1504. The thickness dimension may be relatively small, such as 2.5 millimeters or less, 2.0 millimeters or less, 1.0 millimeters or less, or another distance. Alternatively, the thickness dimension may be a larger distance. The substrate 1502 can be formed from a plurality of dielectric layers 1700 (shown in FIG. 14) that are vertically stacked on top of each other. As shown in FIG. 12, the dielectric layers 1700 can be oriented parallel to each other. The device 1500 includes a ferrite body 1506 that may be entirely disposed within the thickness dimension of the substrate 1502. In the illustrated embodiment, the ferrite body 1506 has a toroid or anulus shape that extends around an interior opening 1508. Alternatively, the ferrite body 1506 may have a different shape.

Figure 13:
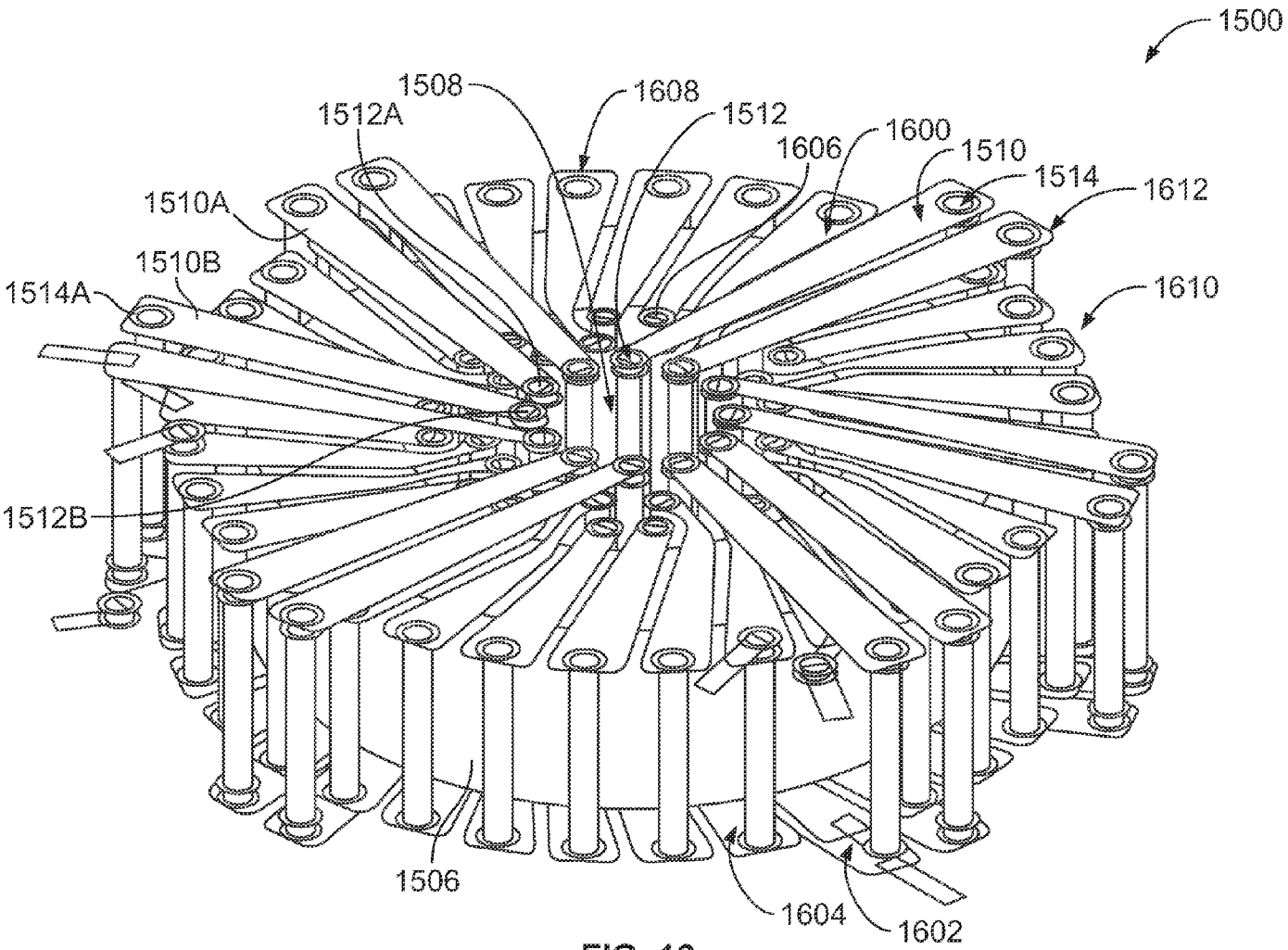
FIG. 13 is a perspective view of the device shown in FIG. 12.
Figure 14:
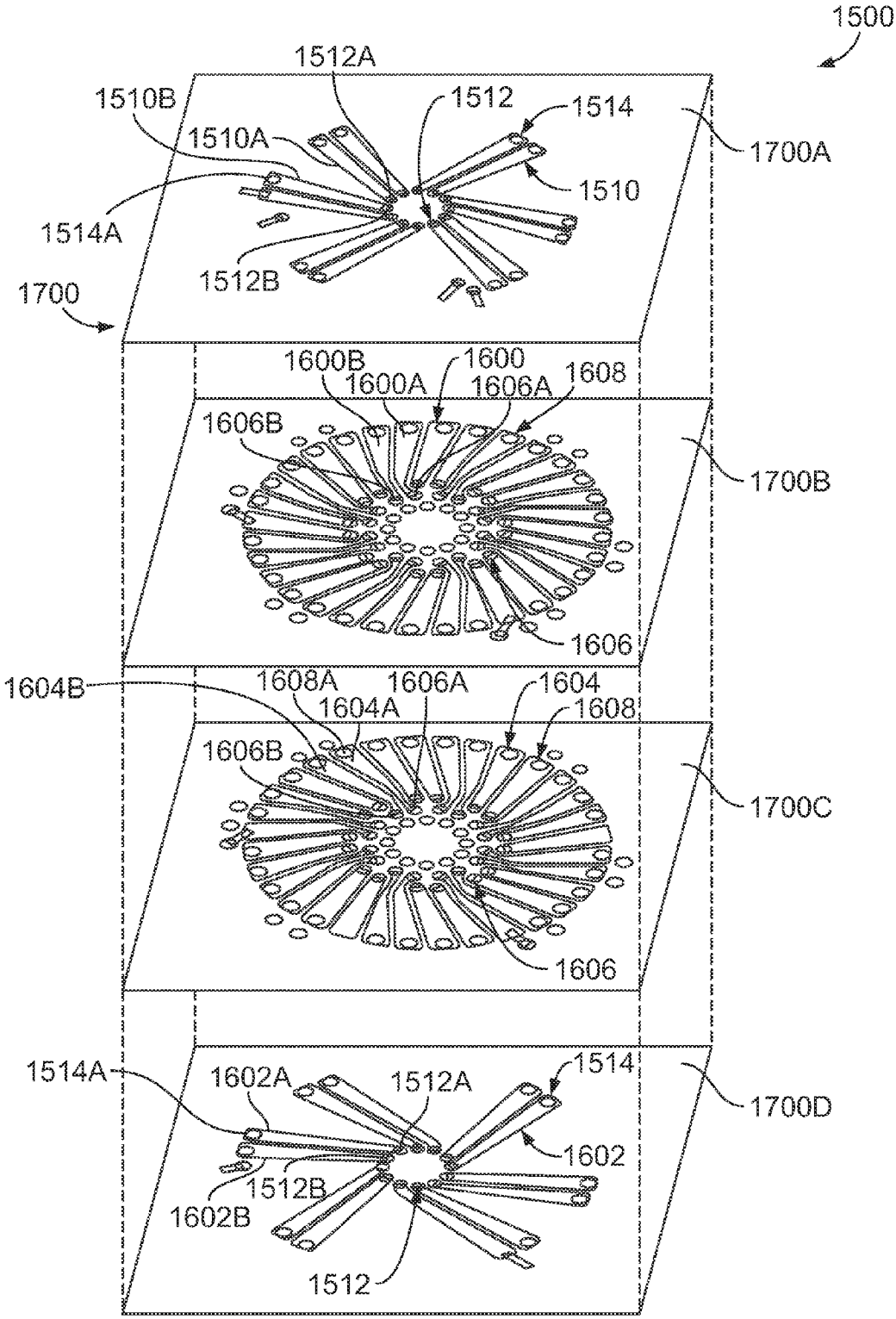
FIG. 14 is an exploded view of the device shown in FIG. 12.

With continued reference to FIG. 12, FIG. 13 is a perspective view of the device 1500 with the substrate 1502 not shown in FIG. 13. FIG. 14 is an exploded view of the device 1500. The ferrite body 1506 is not shown in FIG. 14. The substrate 1502 may be a multilayer body that includes several dielectric layers 1700 (shown in FIG. 14) that are sandwiched on one another. For example, the substrate 1502 may include several layers of FR-4 and/or epoxy material that form the various dielectric layers 1700. The dielectric layers 1700 are individually referred to with the reference number 1700 and are individually referred to by the reference numbers 1700A, 1700B, 1700C, and 1700D. While only four dielectric layers 1700 are shown in FIG. 14, alternatively, several more dielectric layers 1700 may be provided. For example, a plurality of dielectric layers 1700 may be provided between the dielectric layers 1700A and 1700B, between the dielectric layers 1700B and 1700C, and/or between the dielectric layers 1700C and 1700D. In the illustrated embodiment, several dielectric layers 1700 are provided between the dielectric layers 1700B and 1700C. The dielectric layers 1700 between the dielectric layers 1700B and 1700C may include openings to form a cavity that receives the ferrite body 1506, as described above.

The device 1500 includes several conductors 1510, 1600, 1602, 1604 and conductive vias 1512, 1514, 1606, 1608. The conductors 1510, 1600, 1602, 1604 are shown as conductive layers, such as conductive traces. Alternatively, and as described below, the conductors 1510, 1600, 1602, 1604 may include one or more other conductive bodies, such as wire bonds. The conductors 1510 may be referred to as outer upper conductors 1510 that are disposed at or near the upper surface 1504 (shown in FIG. 12) of the substrate 1502. For example, the outer upper conductors 1510 may include conductive traces that are deposited on the upper surface 1504 of the substrate 1502 or on the dielectric layer 1700A that is located beneath the upper surface 1504. The outer upper conductors 1510 are generally referred to by the reference number 1510 and are individually referred to by the reference numbers 1510A, 1510B, 1510C, and so on. In one embodiment, one or more of the conductors 1510, 1600, 1602, 1604 can be combined with wire bonds and/or replaced with wire bonds, similar to as described below in connection with FIGS. 15, 19, and/or 20. The conductors 1602 may be referred to as outer lower conductors 1602 that are disposed at or near the lower surface of the substrate 1502 (shown in FIG. 12), such as at or near the lower surface 106 (shown in FIG. 1) of the substrate 102 (shown in FIG. 1). For example, the outer lower conductors 1602 may include conductive traces that are deposited on the lower surface of the substrate 1502 or on the dielectric layer 1700D that is located above the lower surface. The outer lower conductors 1602 are generally referred to by the reference number 1602 and are individually referred to by the reference numbers 1602A, 1602B, 1602C, and so on.

The conductors 1600 may be referred to as inner upper conductors 1600 that are disposed within the substrate 1502. For example, the inner upper conductors 1600 may include conductive traces that are deposited on the dielectric layer 1700B, with the dielectric layer 1700B disposed between the dielectric layer 1700A having the outer upper conductors 1510 and the lower surface of the substrate 1502. The inner upper conductors 1600 are generally referred to by the reference number 1600 and are individually referred to by the reference numbers 1600A, 1600B, 1600C, and so on.

The conductors 1604 may be referred to as inner lower conductors 1604 that are disposed within the substrate 1502. For example, the inner lower conductors 1604 may include conductive traces that are deposited on the dielectric layer 1700C, with the dielectric layer 1700C disposed between the dielectric layer 1700D having the outer lower conductors 1602 and the dielectric layer 1700B having the inner upper conductors 1600. The inner lower conductors 1604 are generally referred to by the reference number 1604 and are individually referred to by the reference numbers 1604A, 1604B, 1604C, and so on.

The vias 1512, 1514, 1606, 1608 vertically extend through the substrate 1502 to conductively couple the conductors 1510, 1600, 1602, 1604. The vias 1512 may be referred to as a first inner set of interior vias 1512 that are disposed inside the opening 1508 of the ferrite body 1506. The interior vias 1512 conductively couple the outer upper conductors 1510 with the outer lower conductors 1602. The vias 1514 may be referred to as a first outer set of exterior vias 1514 that are disposed outside of the ferrite body 1506. For example, the vias 1512 and the vias 1514 may be located on opposite sides of the ferrite body 1506. The exterior vias 1514 conductively couple the outer upper conductors 1510 with the outer lower conductors 1602. The interior vias 1512 are generally referred to by the reference number 1512 and are individually referred to by the reference numbers 1512A, 1512B, 1512C, and so on. The exterior vias 1514 are generally referred to by the reference number 1514 and are individually referred to by the reference numbers 1514A, 1514B, 1514C, and so on.

The vias 1606 may be referred to as a second inner set of interior vias 1606 that are disposed inside the opening 1508 of the ferrite body 1506. The interior vias 1606 conductively couple the inner upper conductors 1600 with the inner lower conductors 1604. The vias 1608 may be referred to as a second outer set of exterior vias 1608 that are disposed outside of the ferrite body 1506. For example, the interior vias 1606 and the exterior vias 1608 may be located on opposite sides of the ferrite body 1506. The exterior vias 1608 conductively couple the inner upper conductors 1600 with the inner lower conductors 1604. The interior vias 1606 are generally referred to by the reference number 1606 and are individually referred to by the reference numbers 1606A, 1606B, 1606C, and so on. The exterior vias 1608 are generally referred to by the reference number 1608 and are individually referred to by the reference numbers 1608A, 1608B, 1608C, and so on The conductors 1510, 1600, 1602, 1604 and the vias 1512, 1514, 1606, 1608 are conductively coupled to form one or more conductive coils that helically extend around the ferrite body 1506. For example, the conductors 1510, 1600, 1602, 1604 and the vias 1512, 1514, 1606, 1608 can form inner and outer conductive coils 1610, 1612 that helically wrap around the ferrite body 1506 such that each coil 1610, 1612 extends through the opening 1508 in the ferrite body 1506 and wraps around the exterior of the ferrite body 1506 before returning into the opening 1508 of the ferrite body 1506. The conductive coils 1610, 1612 are not conductively coupled with each other in one embodiment. For example, the conductive coils 1610, 1612 may not have a common conductive body that is coupled to each of the conductive coils 1610, 1612. The conductive coils 1610, 1612 may be capable of inductively transferring electric energy from one coil 1610 or 1612 to the other coil 1612 or 1610, such as in a transformer or choke.

In one embodiment, the outer upper conductors 1510, the outer lower conductors 1602, the first inner vias 1512, and the first outer vias 1514 form the outer conductive coil 1612 and the inner upper conductors 1600, the inner lower conductors 1604, the second inner vias 1606, and the second outer vias 1608 form the inner conductive coil 1610. The outer conductors 1510, 1602 may be elongated in directions that are obliquely oriented, or angled, with respect to each other. The first inner and outer vias 1512, 1514 can be coupled with different outer conductors 1510, 1602 to form the outer conductive coil 1612. As shown in FIG. 14, for example, the outer upper conductor 1510A can be conductively coupled with the interior via 1512A. The first inner via 1512A conductively couples the outer upper conductor 1510A with the outer lower conductor 1602A. The outer lower conductor 1602A also is conductively coupled with the exterior via 1514A. The first outer via 1514A is conductively coupled with the outer upper conductor 1510B. The outer upper conductor 1510B is conductively coupled with the first inner via 1512B. The first inner via 1512B conductively couples the outer upper conductor 1510B with the outer lower conductor 1602B. The progression of the first inner and outer vias 1512, 1514 coupling different outer upper conductors 1510 with different outer lower conductors 1602 continues to form the helical outer conductive coil 1612. In the illustrated embodiment, the outer conductive coil 1612 helically wraps around the ferrite body 1506 twelve times. Alternatively, the outer conductive coil 1612 helically wraps around the ferrite body 1506 a different number of times.

Similarly, the second inner and outer vias 1606, 1608 can be coupled with different inner conductors 1600, 1604 to form the inner conductive coil 1610. As shown in FIG. 14, for example, the inner upper conductor 1600A can be conductively coupled with the second inner via 1606A. The second inner via 1606A conductively couples the inner upper conductor 1600A with the inner lower conductor 1604A. The inner lower conductor 1604A is coupled with the second inner via 1606A and with the second outer via 1608A. The second outer via 1608A conductively couples the inner lower conductor 1604A with a different inner upper conductor 1600B. The inner upper conductor 1600B is coupled with a different inner via 1606B, which is coupled with a different inner lower conductor 1604B. This progression of the inner and outer vias 1606, 1608 coupling different inner upper conductors 1600 with different inner lower conductors 1604 continues to form the helical inner conductive coil 1610. In the illustrated embodiment, the inner conductive coil 1610 helically wraps around the ferrite body 1506 thirty-two times. Alternatively, the inner conductive coil 1612 helically wraps around the ferrite body 1506 a different number of times.

The conductive coils 1610, 1612 can provide inductive components for an electronic circuit. For example, one or more conductive traces, wires, or other bodies may be coupled with the conductive coils 1610, 1612 to form a transformer (e.g., where the conductive coils 1610, 1612 inductively pass electric current between two circuits), a choke, balun, or other component. When constructing different inductive elements such as transformer, balun, inductor, chokes, and the like, such as the device 1600, one or more techniques for conductively coupling conductors or conductive layers as shown in FIGS. 21 through 23 and described above. In the case of a transformer device that is used for DSL and/or Ethernet applications, the dielectric separation between conductors can provide relatively large dielectric voltage isolation, such as electric isolation at voltages of up to 5000 V. Alternatively, the dielectric separation can provide relatively large dielectric voltage isolation at other voltages.

Figure 15:
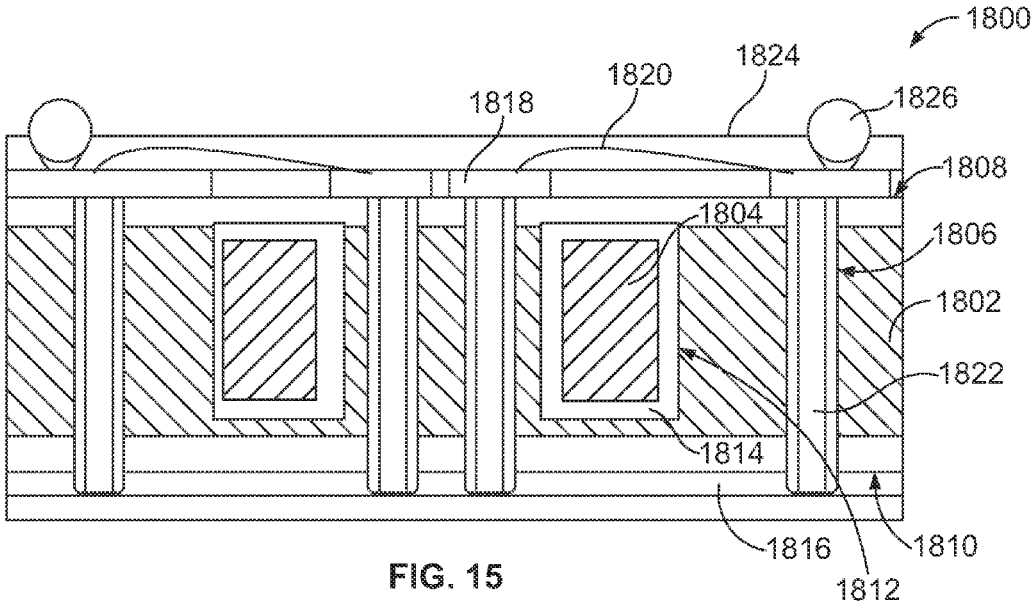
FIG. 15 is a cross-sectional view of another embodiment of a planar inductor device.

FIG. 15 is a cross-sectional view of another embodiment of a planar inductor device 1800. The device 1800 may be similar to the device 1500 shown in FIGS. 12 through 14. For example, the device 1800 may include a planar substrate 1802 having a toroid or annulus shaped ferrite body 1804 disposed within the substrate 1802 and one or more conductive coils 1806 helically wrapping around the ferrite body 1804. The substrate 1802 extends between opposite upper and lower surfaces 1808, 1810. An interior cavity 1812 is disposed within the substrate 1802 between the upper and lower surfaces 1808, 1810. The ferrite body 1804 is located within the cavity 1812. In the illustrated embodiment, the cavity 1812 is filled or substantially filled with a dielectric material 1814, such as a flexible epoxy material, such that the dielectric material 1814 at least partially encloses the ferrite body 1804 in the cavity 1812. Alternatively, the cavity 1812 may be filled or substantially filled with air or another gas, such that the air or gas at least partially surrounds the ferrite body 1804 in the cavity 1812.

In the illustrated embodiment, lower conductive layers 1816 are disposed on the lower surface 1810 of the substrate 1802. For example, the lower conductive layers 1816 may be conductive traces deposited on the lower surface 1810. Conductive vias 1822 are coupled with the lower conductive layers 1816 and vertically extend through the substrate 1802. The vias 1822 can be filled with conductive paste or with another conductive or non-conductive filling material such that the vias 1822 can be capped. Conductive caps 1818 are disposed on the upper surface 1808 of the substrate 1802 and are conductively coupled with the vias 1822. As shown in FIG. 15, the conductive caps 1818 are spaced apart from each other such that the conductive caps 1818 do not contact each other on the upper surface 1808 of the substrate 1802. The conductive vias 1822 may be filled with a conductive material, such as a metal, metal alloy, solder, or other conductive body, that is coupled with the conductive caps 1818.

Wire bonds 1820 are conductively coupled with the conductive caps 1818 to provide conductive pathways between the caps 1818. The wire bonds 1820 are elongated conductive bodies, such as conductive wires. In one embodiment, the wire bonds 1820 are formed from 10 micrometer to 50 micrometer diameter sized gold wires. Alternatively, a different sized wire and/or different material may be used as the wire bonds 1820.

The conductive coil 1806 forms several turns around the ferrite body 1804. In the illustrated embodiment, the turns of the coil 1806 are formed by the vias 1822, the lower conductive layers 1816, the caps 1818, and the wire bonds 1820. A dielectric overmold layer 1824 can be provided above the upper surface 1808 of substrate 1802. The overmold layer 1824 covers or encapsulates the wire bonds 1820 and caps 1818. For example, the wire bonds 1820 may be entirely disposed within the overmold layer 1824. The overmold layer 1824 can provide voltage isolation. In another embodiment, wire bonds may be used in place of or in addition to the lower conductive layers 1816.

In the illustrated embodiment, conductive access to the device 1800 is provided by conductive terminals 1826 that extend through the overmold layer 1824. For example, openings or vias may be formed through the overmold layer 1824 using laser vias and/or mechanical vias. A conductive body may be deposited into the openings or vias that are conductively coupled with one or more of the caps 1818 to form the conductive terminals 1826.

Figure 19:
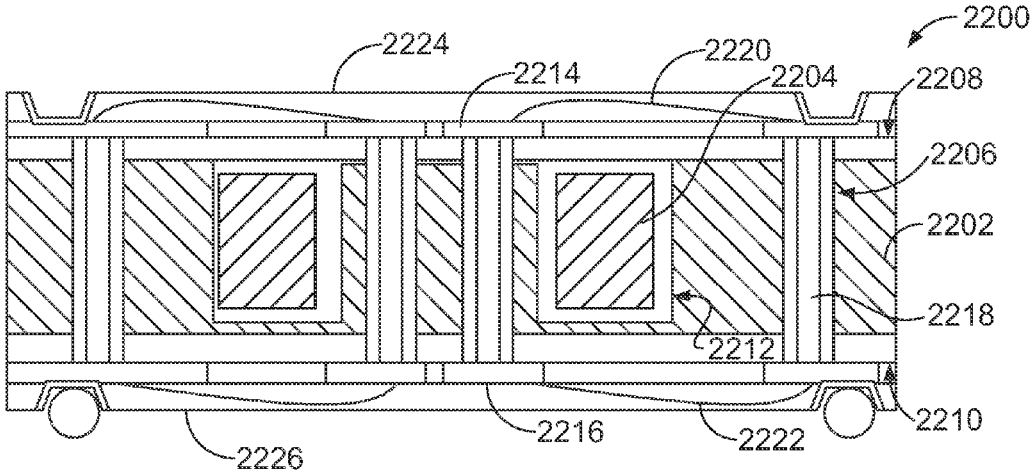
FIG. 19 is a cross-sectional view of another embodiment of a planar inductor device.

FIG. 19 is a cross-sectional view of another embodiment of a planar inductor device 2200. The device 2200 may be similar to the device 1500 shown in FIGS. 12 through 14. For example, the device 2200 may include a planar substrate 2202 having a toroid or anulus shaped ferrite body 2204 disposed within the substrate 2202 and one or more conductive coils 2206 helically wrapping around the ferrite body 2204. The substrate 2202 extends between opposite upper and lower surfaces 2208, 2210. An interior cavity 2212 is disposed within the substrate 2202 and the ferrite body 2204 is located within the cavity 2212. In one embodiment, the interior cavities 2212 can be premade (e.g., formed when the substrate 2202 is created) and/or include posts for the ferrite body 2204 to be disposed upon. The ferrite body 2204 can be mechanically shaken into position using a tapered insert that guides the ferrite body 2204 into the cavity 2212 and onto the post, or the ferrite body 2204 may be placed with a pick and place machine. Alternatively, another technique may be used. The post can provide a supporting framework for the device 2200. In one embodiment, a low stress or an ultra low-stress material, such as silicone, can be used to surround the ferrite body 2204, as described above. In one embodiment, if the device 2200 is used for relatively high voltage and/or current applications, a special grade material may be used for substrate and/or post. The material can have relatively low amounts of halogens and/or be relatively glass bundle-free for increased reliability, as well as providing an encapsulation around the ferrite body 2204 that is hermetic or near hermetic. Examples of such a material can include liquid crystalline polymer (LCP) and/or teflon. Conductive vias 2218 can extend through the substrate 2202 and/or the low-stress material around the ferrite body 2204 and may carry relatively large amounts of electric power. The substrate 2202 can provide relatively high electric isolation between the vias 2218 even in the presence of moisture and high temperatures.

In the illustrated embodiment, upper and lower conductive caps 2214, 2216 are disposed on the upper surface 2208 of the substrate 2202 and are conductively coupled with the conductive vias 2218 that extend through the substrate 2202. The upper conductive caps 2214 can be spaced apart from each other such that the upper conductive caps 2214 do not contact each other and/or the lower conductive caps 2216 can be spaced apart from each other such that the lower conductive caps 2216 do not contact each other. The vias 2218 may be filled with a conductive material, such as a metal, metal alloy, solder, or other conductive body, that is coupled with the upper and lower conductive caps 2214, 2216.

Upper and lower wire bonds 2220, 2222 are conductively coupled with the upper and lower conductive caps 2214, 2216, respectively, to provide conductive pathways between the upper conductive caps 2214 and between the lower conductive caps 2216. Similar to the wire bonds 1820 (shown in FIG. 15), the wire bonds 2220, 2222 are elongated conductive bodies, such as conductive wires. The conductive coil 2206 forms several turns around the ferrite body 2204. In the illustrated embodiment, the turns of the coil 2206 are formed by the vias 2218, the lower conductive caps 2216, the lower wire bonds 2222, the upper conductive caps 2214, and the upper wire bonds 2220. Upper and/or lower dielectric overmold layers 2224, 2226 can be provided to cover or encapsulate the upper and/or lower wire bonds 2220, 2222 and upper and/or lower conductive caps 2214, 2216.

Figure 20:
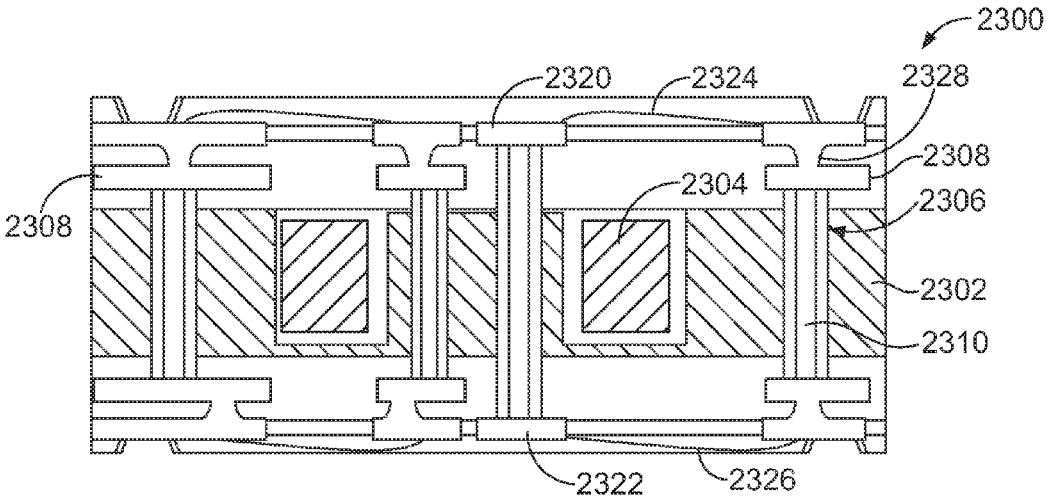
FIG. 20 is a cross-sectional view of another embodiment of a planar inductor device.

FIG. 20 is a cross-sectional view of another embodiment of a planar inductor device 2300. The device 2300 may be similar to the device 1500 shown in FIGS. 12 through 14 and the device 2200 shown in FIG. 19. For example, the device 2300 may include a planar substrate 2302, a toroid or anulus shaped ferrite body 2304, and one or more conductive coils 2306 helically wrapping around the ferrite body 2304. In the illustrated embodiment, the substrate 2302 includes several interior conductive layers 2308 disposed within the thickness of the substrate 2302. The interior conductive layers 2308 may include one or more conductive traces located within the substrate 2302. The substrate 2302 also includes conductive vias 2310 that may be similar to the vias 2218 (shown in FIG. 19), upper and lower conductive caps 2320, 2322 that may be similar to the upper and lower conductive caps 2214, 2216 (shown in FIG. 19), and upper and lower wire bonds 2324, 2326 that may be similar to the upper and lower wire bonds 2220, 2222 (shown in FIG. 19).

One difference between the devices 2200 and 2300 is that the wire bonds 2324, 2326 of the device 2300 are conductively coupled with one or more of the interior conductive layers 2308 by microvias 2328 in the substrate 2302. The microvias 2328 can include channels or holes in the substrate 2302 that are filled and/or plated with conductive materials, such as metals, metal alloys, and the like. The microvias 2328 may not entirely extend through the thickness of the substrate 2302, as shown in FIG. 20. For example, the microvias 2328 may only partially extend through the substrate 2302 between two or more interior conductive layers 2308 and/or between an interior conductive layer 2308 and an upper or lower conductive cap 2320, 2322.

Figure 16:
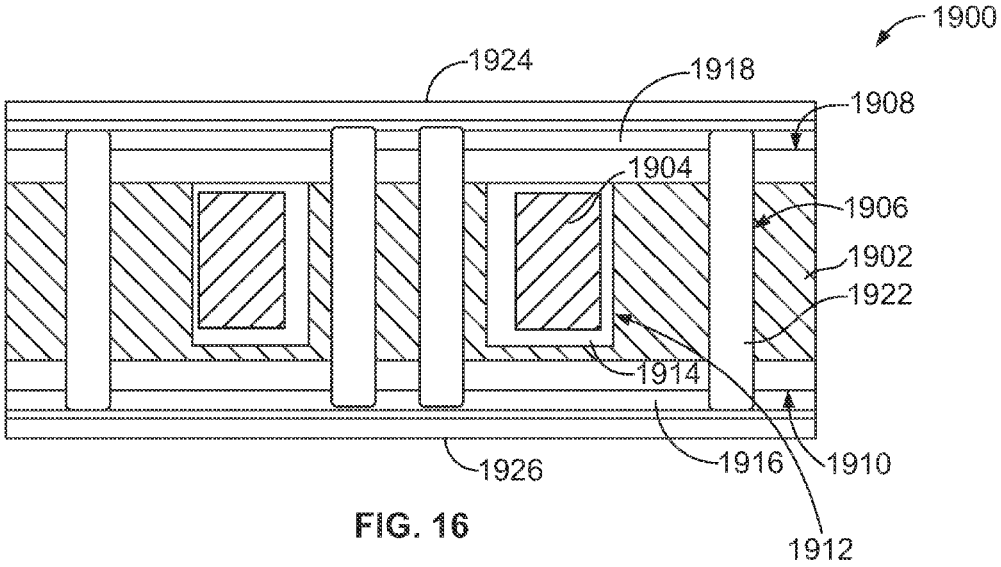
FIG. 16 is a cross-sectional view of another embodiment of a planar inductor device.

FIG. 16 is a cross-sectional view of another embodiment of a planar inductor device 1900. The device 1900 may be similar to the device 1500 shown in FIGS. 12 through 14. For example, the device 1900 may include a planar substrate 1902 having a toroid or anulus shaped ferrite body 1904 disposed within the substrate 1902 and one or more conductive coils 1906 helically wrapping around the ferrite body 1904. The substrate 1902 extends between opposite upper and lower surfaces 1908, 1910. An interior cavity 1912 is disposed within the substrate 1902 between the upper and lower surfaces 1908, 1910. The ferrite body 1904 is located within the cavity 1912. Upper and lower conductive layers 1918, 1916 and conductive vias 1922 form the conductive coil 1906 that helically wraps around the ferrite body 1904, as described above.

In the illustrated embodiment, the cavity 1912 is filled or substantially filled with a flexible dielectric material 1914 that is mixed with and/or includes one or more relatively high permeability materials. A "high permeability" material may include a material having a magnetic relative permeability ($\mu r$) of at least 100. In one embodiment, the ferrite body 1904 may be at least partially surrounded by an epoxy material that is mixed with high permeability powders, such as nanopowders of cobalt, nickel, manganese, chromium, iron, and the like. In another embodiment, the ferrite body 1904 can not be provided and the cavity 1912 may be filled with the material 1914 mixed with the high permeability materials. The material 1914 and high permeability materials may replace the ferrite body 1904 in an inductor device that is formed by conductive coil 1906 helically wrapped around the material 1914 with the high permeability materials.

Upper and lower high permeability layers 1924, 1926 may be deposited outside of the substrate 1902 on the upper and lower surfaces 1908, 1910, respectively. The layers 1924, 1926 may be formed from a flexible dielectric material that is mixed with or includes one or more high permeability materials, similar to the material 1914 in the cavity 1912. The layers 1924, 1926 can reduce or prevent flux leakage from the device 1900 and/or increase the effective permeability of the device 1900.

Figure 17:
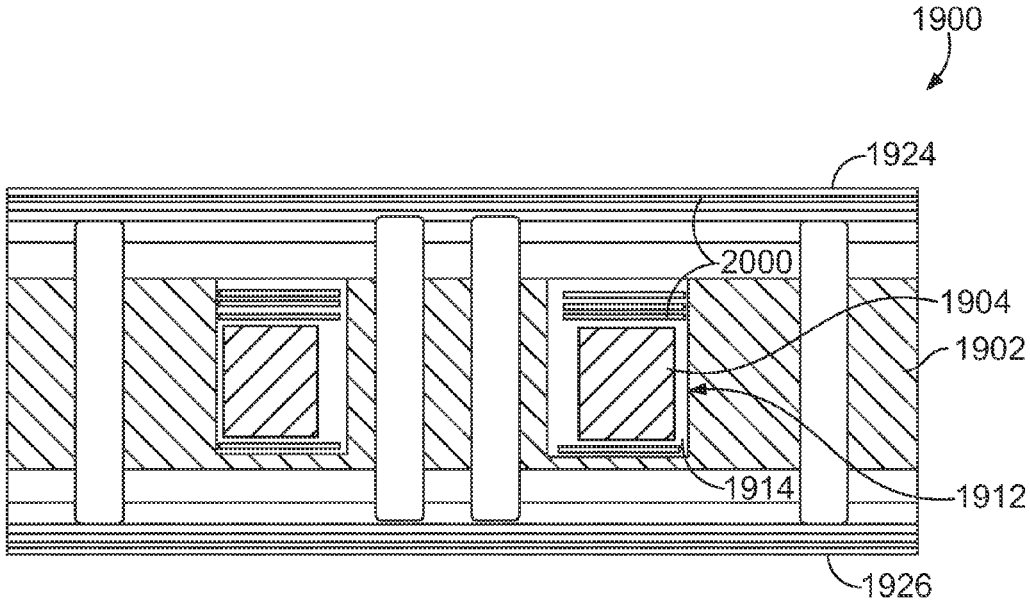
FIG. 17 is a cross-sectional view of another embodiment of the planar inductor device shown in FIG. 16.

FIG. 17 is a cross-sectional view of another embodiment of the planar inductor device 1900 shown in FIG. 16. In the illustrated embodiment, one or more planar ferrite slabs 2000 are disposed within the cavity 1912 in the substrate 1902. As shown in FIG. 17, the slabs 2000 may be disposed above and below the ferrite body 1904. The slabs 2000 may be held in place by the material 1914 in the cavity 1912. The slabs 2000 may be planar bodies that are formed from or include a ferrite material, such as cobalt, nickel, manganese, chromium, iron, and the like. In one embodiment, the slabs 2000 may be ferrite material sheets that are 8 to 10 micrometers thick. Alternatively, the slabs 2000 may be a different thickness.

As shown in FIG. 17, one or more of the slabs 2000 may be provided in the upper and/or lower layers 1924, 1926. For example, slabs 2000 that extend over a substantial portion of the upper and/or lower surfaces 1908, 1910 of the substrate 1902 may be held in the layers 1924, 1926. The slabs 2000 can further reduce or prevent flux leakage from the device 1900 and/or increase the effective permeability of the device 1900.

In one embodiment, one or more of the material 1914 having the high permeability material and/or the ferrite slabs 2000 may be provided in connection with one or more of the devices 100, 300, 500, 1100, 1500 (shown in FIGS. 1, 3, 5, 8, and 12). For example, one or more of the ferrite bodies 110, 310, 510, 1116, 1506 (shown in FIGS. 1, 3, 5, 8, and 12) may be disposed within a cavity that is filled or substantially filled with the dielectric material 1914 that includes high permeability materials and/or one or more of the slabs 2000.

Figure 24:
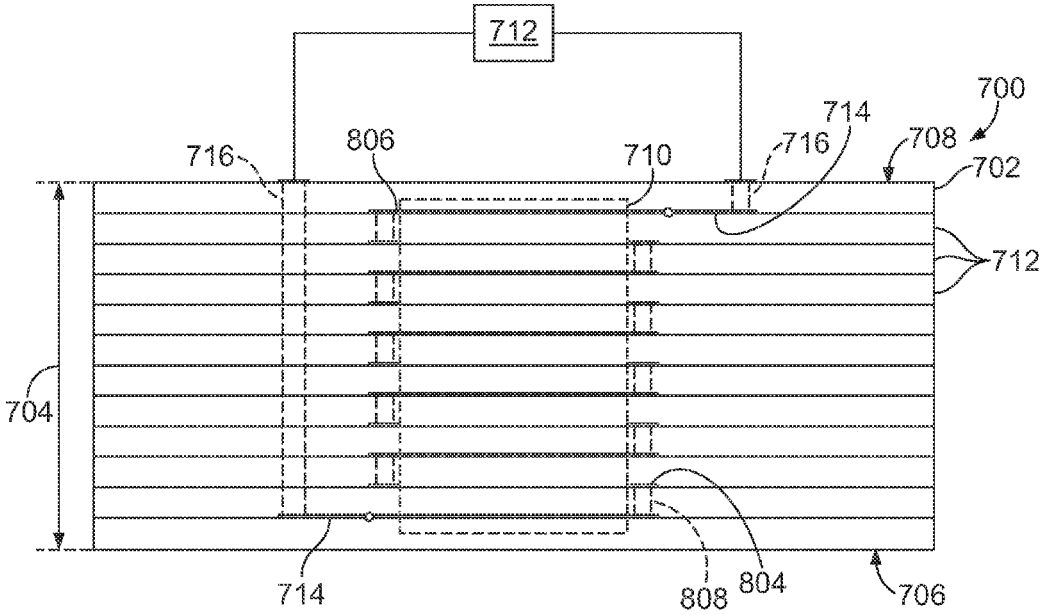
FIG. 24 is a side view of a planar inductor device in accordance with another embodiment.

FIG. 24 is a side view of a planar inductor device 700 in accordance with another embodiment. The device 1800 may be similar to one or more devices shown and described herein, such as the device 100 shown in FIG. 1. For example, the device 700 includes a substrate 702 having a thickness dimension 704 that vertically extends from a lower surface 706 to an opposite upper surface 708. The thickness dimension 704 may be relatively small, such as 2.5 millimeters or less, 2.0 millimeters or less, 1.0 millimeters or less, or another distance. Alternatively, the thickness dimension 704 may be a larger distance. The device 700 also includes a ferrite body 710 that may be entirely disposed within the thickness dimension 704 of the substrate 702. In one embodiment, the substrate 702 may include an interior cavity, such as the cavity 120 (shown in FIG. 1) of the substrate 102 (shown in FIG. 1), with the ferrite body 710 disposed in the cavity.

The substrate 702 can be formed from a plurality of dielectric layers 712 that are vertically stacked on top of each other. While only twelve layers 712 are shown in the illustrated embodiment, alternatively, a larger or smaller number of the layers 712 may be provided. The layers 712 include or are formed from a dielectric material, such as FR-4, cured epoxy, polytetrafluoroethylene, FR-1, CEM-1, CEM-3, thermoplastics, spin-coated epoxies and the like. The layers 712 may be held together to form the substrate 702 by one or more adhesives, such as epoxy.

The ferrite body 710 is positioned within the substrate 702 such that the ferrite body 710 extends through several of the layers 712. The ferrite body 710 may be located within axially-aligned through holes 802 (shown in FIG. 19) in the layers 712, while remaining entirely disposed within the thickness dimension 704 of the substrate 702. Alternatively, the ferrite body 710 may protrude outside of the thickness dimension 704 of the substrate 702, such as by projecting above a plane defined by the upper surface 708 and/or below a plane defined by the lower surface 706.

Figure 25:
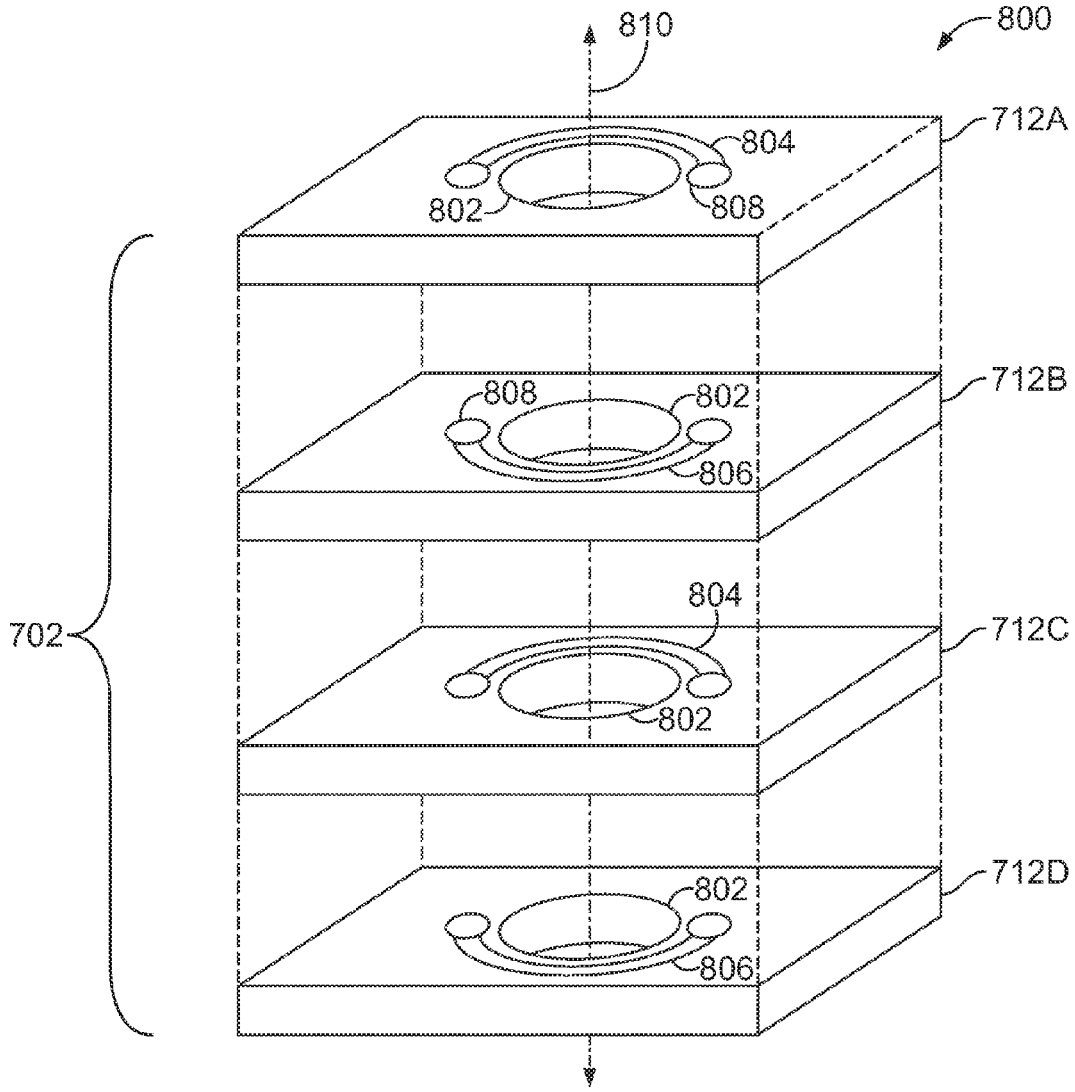
FIG. 25 is an exploded view of one embodiment of a subset of layers in a substrate shown in FIG. 24.

With continued reference to FIG. 24, FIG. 25 is an exploded view of one embodiment of a subset 800 of the layers 712 in the substrate 702. The subset 800 can include less than all of the layers 712 that are vertically stacked on each other in the substrate 702. The layers 712 are collectively referred to in FIG. 25 by the reference number 712 and are individually referred to by the reference numbers 712A, 712B, 712C, and 712D. While the description herein focuses on the subset 800 of layers 712, alternatively, the description may be applied to more than the four layers 712 in the subset 800. For example, the description of the layers 712A-D may apply to all of the layers 712 through which the ferrite body 710 extends inside of the substrate 702.

As shown in FIG. 25, the layers 712A-D include holes 802 that are axially aligned with each other along a center axis 810. The center axis 810 may be parallel to the direction in which the thickness dimension 704 of the substrate 702 is measured. The holes 802 are shaped to receive the ferrite body 710. For example, the holes 802 may have a circular shape with a diameter that is sufficiently large such that a cylindrical ferrite body 710 can be disposed within the holes 802. Alternatively, the holes 802 may have a different shape. The layers 712A-D encircle the ferrite body 710 in the planes defined by the respective layers 712A-D when the ferrite body 710 is disposed in the holes 802.

The layers 712A-D include conductors 804, 806 that partially extend around the ferrite body 710 within the respective layer 712A-D. The conductors 804, 806 may be formed as conductive traces or layers disposed on or in the layers 712A-D. As shown in FIG. 25, each of the conductors 804, 806 encircles or extends around a portion of the hole 802 in the corresponding layer 712A-D. The conductor 804 or 806 in each layer 712 can extend around less than the entire outer periphery of the hole 802 in the same layer 712. In the illustrated embodiment, each of the conductors 804, 806 has an approximate shape of an arc that subtends approximately 180 degrees of the circumference of the hole 802. Alternatively, the conductors 804, 806 may have a different shape and/or subtend a different angle or extend around a different fraction of the outer periphery or circumference of the hole 802.

The conductors 804, 806 are coupled with conductive microvias 808. For example, each of the conductors 804, 806 may extend from a first microvia 808 to a second microvia 808 in the same layer 712 as the conductor 804, 806. As shown in FIG. 24, the microvias 808 extend through the layers 712. The microvias 808 provide vertically oriented conductive pathways that extend through one or more of the layers 712 while the conductors 804, 806 provide horizontal conductive pathways within separate layers 712. In the illustrated embodiment, each of the conductors 804, 806 can provide a horizontal conductive pathway within a layer 712 while each of the microvias 808 provides a vertical conductive pathway or interconnect through the thickness of the layer 712. The microvias 808 are shown as buried vias as the microvias 808 are not exposed at the upper surface 708 or the lower surface 706 of the substrate 702. Alternatively, one or more of the microvias 808 may be exposed at the upper surface 708 or the lower surface 706 of the substrate 702.

The microvias 808 in the layers 712 conductively couple the conductors 804, 806 in different layers 712 with each other. For example, the microvias 808 in the layer 712A extend through the layer 712A to conductively couple the conductor 804 in the layer 712A with the conductor 806 in the layer 712B. Similarly, the microvias 808 in the layer 712B extend through the layer 712B to conductively couple the conductor 806 in the layer 712B with the conductor 804 in the layer 712C, and so on. In the illustrated embodiment, each of the microvias 808 conductively couples conductors 804, 806 disposed on or in different and adjacent layers 712. Alternatively, the microvias 808 may extend through more than one layer 712 to conductively couple conductors 804, 806 in different, non-adjacent layers 712, or layers 712 that are separated from each other by one or more other layers 712.

Figure 26:
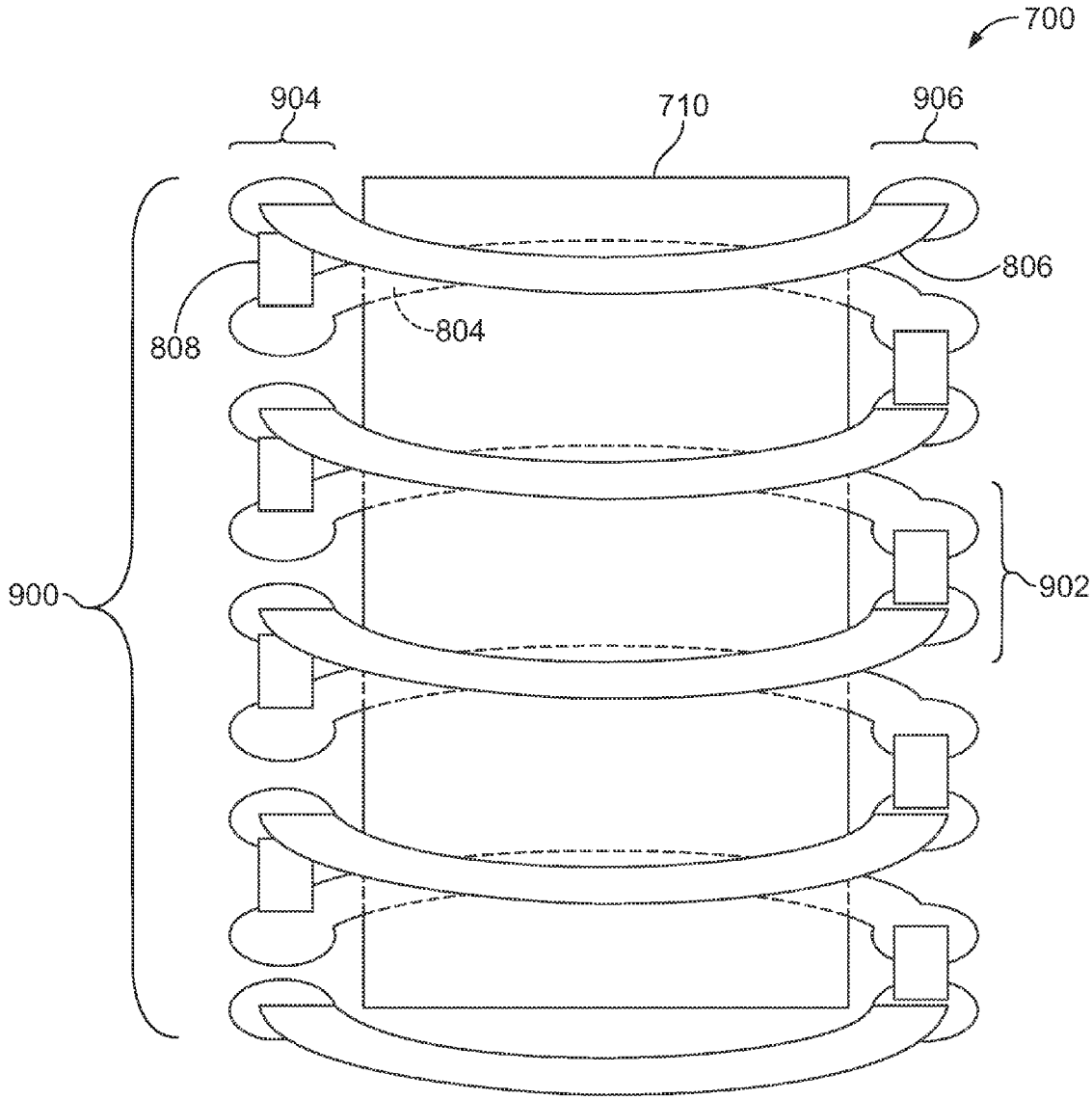
FIG. 26 is a schematic view of the inductor device shown in FIG. 24 in accordance with one embodiment.

FIG. 26 is a schematic view of the inductor device 700 in accordance with one embodiment. The device 700 is shown in FIG. 26 with the substrate 702 (shown in FIG. 24) removed to make the relative positions of the conductors 804, 806, the microvias 808, and the ferrite body 710 more clear. The conductors 804, 806 and the microvias 808 are conductively coupled with each other to form a multi-layer conductive coil 900 that helically wraps around the ferrite body 710. As shown in FIG. 26, each of the conductors 804, 806 forms a portion of a turn 902 of the coil 900 that extends around the ferrite body 710. The term "turn" is meant to encompass a portion of the coil 900 that extends around the outer periphery of the ferrite body 710 a single time, or that subtends an arc or non-planar circle of 360 degrees. In the illustrated embodiment, each conductor 804, 806 subtends an arc of approximately 180 degrees such that the microvias 808 in different layers 712 (shown in FIG. 24) are vertically aligned with each other in two sets 904, 906 of microvias 808, with the sets 904, 906 located on opposite sides of the ferrite body 710. Alternatively, the conductors 804, 806 may subtend arcs of smaller or larger angles such that the microvias 808 are not vertically aligned with each other or are vertically aligned with each other in a single set or in multiple sets of microvias 808.

Returning to the discussion of the device 700 as shown in FIG. 24, the device 700 may provide an inductive element to an electronic circuit 712. The device 700 may be conductively coupled with conductive traces 714 and/or vias 716 that provide conductive pathways with the circuit 712. While the traces 714 and vias 716 couple the circuit 712 with opposite ends of the coil 900 (shown in FIG. 26) formed by the conductors 804, 806 and the microvias 808, alternatively, the traces 714 and vias 716 couple the circuit 712 with different points or locations along the coil 900. For example, the traces 714 and vias 716 may be conductively coupled with the conductors 804, 806 and/or microvias 808 in layers 712 other than the layers 712 shown in FIG. 26. In operation, current from the circuit 712 flows through the coil 900 formed by the conductors 804, 806 and the microvias 808. At least some of the energy of the current is stored as magnetic energy in the ferrite body 710. The coil 900 may be used to delay and/or reshape currents flowing through the circuit 712, such as by filtering relatively high frequencies from the current.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to one of ordinary skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable a person of ordinary skill in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A planar inductor device comprising:

a ferrite body extending around an opening in the ferrite body; and a conductive pathway comprising an input section, a current-splitting section, a coil section, a current-combining section, and an output section connected with each other, the input section extending toward the opening in the ferrite body, the current-splitting section including a plurality of conductive coils joined with the conductive pathway and electrically disposed parallel to each other, the coil section including the conductive coils helically wrapping around the ferrite body, the current-combining section including the conductive coils joining with each other, and the output section including the joined conductive coils extending out of the ferrite body.

2. The device of claim 1, wherein the input section of the conductive pathway conveys electric current (I) toward the ferrite body, the current-splitting section divides the electric current (I) into first and second current fractions ($I_1$, $I_2$), the coil section separately conveys the first and second current fractions ($I_1$, $I_2$) around the ferrite body in the different conductive coils, the current-combining section combines the first and second current fractions ($I_1$, $I_2$) into a combined electric current, and the output section conveys the combined electric current out of the device.

3. The device of claim 1, wherein the input section of the conductive pathway includes a planar input conductor disposed above the ferrite body, the current-splitting section of the conductive pathway includes a planar current-splitting conductor disposed below the ferrite body, the current-combining section of the conductive pathway includes a planar current-combining conductor disposed above the ferrite body, and the output section of the conductive pathway includes a planar output conductor disposed below the ferrite body.

4. The device of claim 3, wherein the conductive pathway includes one or more conductive input vias conductively coupling the input conductor with the current-splitting conductor.

5. The device of claim 4, wherein the input vias are disposed within the opening of the ferrite body.

6. The device of claim 3, wherein the conductive pathway includes one or more conductive current-splitting vias conductively coupling the current-splitting conductor with the current-combining conductor.

7. The device of claim 6, wherein the current-splitting vias are disposed outside of the ferrite body.

8. The device of claim 3, wherein the conductive pathway includes one or more conductive current-combining vias conductively coupling the current-splitting conductor with the output conductor.

9. The device of claim 1, wherein the ferrite body is divided into a plurality of separate sections.

10. The device of claim 9, further comprising a buffer layer disposed between the separate sections of the ferrite body, the buffer layer including at least one of a non-conductive material or a non-magnetic material.

11. The device of claim 1, further comprising one or more wire bonds coupled with at least one of the input section, the current-splitting section, the coil section, the current-combining section, or the output section.

12. The device of claim 1, further comprising a substrate extending from an upper surface to an opposite lower surface, the ferrite body disposed within the substrate between the upper surface and the lower surface.

13. A planar inductor device comprising:

a substrate vertically extending between an upper surface and an opposite lower surface;

a ferrite body disposed in the substrate between the upper surface and the lower surface, the ferrite body having an opening that extends through the ferrite body;

an input conductor disposed between the ferrite body and the upper surface of the substrate;

a current-splitting conductor disposed between the ferrite body and the lower surface of the substrate;

one or more conductive input vias coupled with both the input conductor and the current-splitting conductor;

a current-combining conductor disposed between the ferrite body and the upper surface of the substrate; and one or more current-splitting vias coupled with both the current-splitting conductor and the current-combining conductor, wherein the input conductor, the current-splitting conductor, the current-combining conductor, the input vias, and the current-splitting vias form a conductive pathway that extends into the opening in the ferrite body and forms a plurality of conductive coils that each helically wrap around the ferrite body before combining back together and extending out of the opening in the ferrite body.

14. The device of claim 13, wherein the conductive coils of the conductive pathway are electrically disposed parallel to each other.

15. The device of claim 13, wherein the input conductor conveys electric current (I) toward the ferrite body, the current-splitting vias and the current-splitting conductor divide the electric current (I) into first and second current fractions ($I_1$, $I_2$) and convey the first and second current fractions ($I_1$, $I_2$) helically around the ferrite body, and the current-combining vias and the current-combining conductor combine the first and second current fractions ($I_1$, $I_2$) into a combined electric current that is conveyed out of the device.

16. The device of claim 13, wherein the input vias are disposed within the opening of the ferrite body.

17. The device of claim 13, wherein the current-splitting vias are disposed outside of the ferrite body.

18. The device of claim 13, wherein the ferrite body is divided into a plurality of separate sections such that the ferrite body is a non-continuous body.

19. The device of claim 18, further comprising a buffer layer disposed between the separate sections of the ferrite body, the buffer layer including at least one of a non-conductive material or a non-magnetic material.

20. The device of claim 13, further comprising one or more wire bonds coupled with at least one of the input conductor, the current-splitting conductor, or the current-combining conductor.

* * * * *